US009205342B2

(12) United States Patent
Teel et al.

(10) Patent No.: US 9,205,342 B2
(45) Date of Patent: Dec. 8, 2015

(54) DOLL STANDS AND METHODS OF USING DOLL STANDS HAVING AN ELECTROSTATIC CHARGE GENERATING DEVICE

(71) Applicant: Mattel, Inc., El Segundo, CA (US)

(72) Inventors: Peter E. Teel, Los Angeles, CA (US); Scott E. Wilger, Redondo Beach, CA (US); James A. Molina, Riverside, CA (US); James P. Zielinski, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/557,320

(22) Filed: Dec. 1, 2014

(65) Prior Publication Data

US 2015/0151207 A1 Jun. 4, 2015

Related U.S. Application Data

(60) Provisional application No. 61/911,149, filed on Dec. 3, 2013, provisional application No. 61/924,627, filed on Jan. 7, 2014, provisional application No. 61/945,382, filed on Feb. 27, 2014.

(51) Int. Cl.
*A63H 3/50* (2006.01)

(52) U.S. Cl.
CPC ..... *A63H 3/50* (2013.01)

(58) Field of Classification Search
None
See application file for complete search history.

(56) References Cited

U.S. PATENT DOCUMENTS

| | | | | | |
|---|---|---|---|---|---|
| 278,565 | A | | 5/1883 | Lembcke | |
| 477,975 | A | | 6/1892 | Waite | |
| 1,573,122 | A | | 2/1926 | Rank | |
| 1,604,087 | A | * | 10/1926 | Tate | 472/70 |
| 1,659,025 | A | | 2/1928 | Hanback | |
| 1,991,236 | A | * | 2/1935 | Van De Graaff | 310/308 |
| 2,018,585 | A | | 10/1935 | Hermann | |
| 2,465,076 | A | * | 3/1949 | Englander | 248/414 |
| 2,553,111 | A | | 5/1951 | Quillen | |
| 3,081,780 | A | | 3/1963 | Cramer | |

(Continued)

FOREIGN PATENT DOCUMENTS

| | | |
|---|---|---|
| GB | 2 273 554 | 6/1994 |
| GB | 2 317 836 | 4/1998 |

OTHER PUBLICATIONS

S J James, Barbie on the Van De Graaff, https://www.youtube.com/watch?v=Rnvda3dn8SM, May 12, 2012.

*Primary Examiner* — Tramar Harper
(74) *Attorney, Agent, or Firm* — Foley & Lardner LLP

(57) ABSTRACT

A stand includes a supporting structure for supporting a doll and an electrostatic charge generating device supported by the supporting structure for causing hair of the doll to move when the doll is supported by the supporting structure and the electrostatic charge generating device is activated. A method of using a stand for a doll includes supporting the doll with a supporting structure of the stand and activating an electrostatic charge generating device that is supported by the supporting structure to cause hair of the doll to move. The supporting structure may include a conductive member made of carbon-impregnated plastic for contacting the doll and for transferring charge generated by the electrostatic charge generating device to the doll. The conductive member may be moveable in response to a positioning of the doll to provide for user safety. The stand may also include an electrical disconnect mechanism for user safety.

19 Claims, 18 Drawing Sheets

(56) References Cited

U.S. PATENT DOCUMENTS

| | | | | | |
|---|---|---|---|---|---|
| 3,084,478 | A | | 4/1963 | Burger | |
| 3,239,961 | A | * | 3/1966 | Forkner | 446/130 |
| 3,477,448 | A | | 11/1969 | Peruski | |
| 3,500,578 | A | | 3/1970 | Irving | |
| 3,531,891 | A | * | 10/1970 | Goldfarb et al. | 446/303 |
| 3,612,918 | A | | 10/1971 | Willutzki | |
| 3,628,283 | A | * | 12/1971 | Mizoule | 446/140 |
| 3,691,680 | A | | 9/1972 | Glass et al. | |
| 4,553,748 | A | * | 11/1985 | Allen et al. | 463/30 |
| 4,993,986 | A | | 2/1991 | Bloomfield | |
| 5,466,181 | A | | 11/1995 | Bennett et al. | |
| 5,743,616 | A | | 4/1998 | Giuliano et al. | |
| 6,190,229 | B1 | | 2/2001 | Nadel et al. | |
| 7,491,110 | B2 | | 2/2009 | Chernick et al. | |
| 7,815,484 | B2 | | 10/2010 | Kriman et al. | |
| 8,011,991 | B2 | | 9/2011 | Asperas | |
| 2006/0172654 | A1 | | 8/2006 | Asperas | |
| 2008/0143214 | A1 | | 6/2008 | McNamara et al. | |
| 2009/0121109 | A1 | * | 5/2009 | Kinmont et al. | 248/346.03 |
| 2009/0140603 | A1 | | 6/2009 | Aslam | |
| 2009/0209171 | A1 | | 8/2009 | Kriman et al. | |
| 2009/0215358 | A1 | * | 8/2009 | Moothedath et al. | 446/139 |
| 2012/0261282 | A1 | * | 10/2012 | Lui et al. | 206/216 |

* cited by examiner

DOLL STANDS AND METHODS OF USING DOLL STANDS HAVING AN ELECTROSTATIC CHARGE GENERATING DEVICE

CROSS-REFERENCE TO RELATED PATENT APPLICATIONS

This application claims priority from U.S. Provisional Patent App. Ser. No. 61/911,149, filed Dec. 3, 2013, and this application also claims priority from U.S. Provisional Patent App. Ser. No. 61/924,627, filed Jan. 7, 2014, and this application also claims priority from U.S. Provisional Patent App. Ser. No. 61/945,382, filed Feb. 27, 2014, the entire contents of each of which are incorporated by reference herein.

FIELD

Embodiments described herein generally relate to doll stands and methods of using doll stands, and particularly to doll stands that include electronic components.

BACKGROUND

Traditional doll stands are used by many doll owners to hold and display dolls. Children, as well as adults, often like using doll stands to showcase their dolls and to show-off their doll fashion styles. Doll stands are also useful when playing with dolls, such as to hold the dolls while they are being styled and to allow for admiring the dolls. Doll stands are also used for storing dolls and for keeping them organized.

SUMMARY OF THE DISCLOSURE

A stand in accordance with an embodiment includes a supporting structure for supporting a doll and an electrostatic charge generating device supported by the supporting structure for causing hair of the doll to move when the doll is supported by the supporting structure and the electrostatic charge generating device is activated. In various embodiments the electrostatic charge generating device is a Van de Graaff generator that is located inside of the supporting structure of the stand and is used to make the hair of the doll stand up on end. In some embodiments, the stand includes one or more light sources supported by the supporting structure. Also, in some embodiments, the stand includes a speaker supported by the supporting structure for emitting one or more sounds.

In some embodiments the stand includes a conductive member for contacting the doll and for transferring charge generated by the electrostatic charge generating device to the doll. Also, in some embodiments the conductive member is movable among a first position in which charge is hindered from being transferred from the electrostatic charge generating device through the conductive member and a second position that promotes the transfer of charge from the electrostatic charge generating device through the conductive member. In various embodiments a biasing member biases the conductive member toward the first position, and the conductive member is positioned in a location such that the conductive member is placed into the second position by the doll when the doll is supported by the supporting structure.

In some embodiments the stand includes an electrical disconnect mechanism that is operable among a first position in which the electrostatic charge generating device is prevented from receiving power from a power supply and a second position in which the electrostatic charge generating device is allowed to receive power from the power supply. In various embodiments the electrical disconnect mechanism is configured such that the electrical disconnect mechanism is in the first position when there is no doll being supported by the supporting structure. Also, in various embodiments the electrical disconnect mechanism is configured such that the electrical disconnect mechanism is placed into the second position when the doll is supported by the supporting structure.

A method of using a stand for a doll in accordance with an embodiment includes supporting the doll with a supporting structure of the stand and activating an electrostatic charge generating device that is supported by the supporting structure to cause hair of the doll to move. In various embodiments the supporting of the doll includes placing the doll in contact with a conductive member of the supporting structure that transfers charge generated by the electrostatic charge generating device to the doll.

In some embodiments, placing the doll in contact with the conductive member causes the conductive member to move from a first position in which charge is hindered from being transferred from the electrostatic charge generating device through the conductive member to a second position that promotes the transfer of charge from the electrostatic charge generating device through the conductive member. In various embodiments the supporting of the doll further includes causing an electrical disconnect mechanism to move from a first position in which the electrostatic charge generating device is prevented from receiving power from a power supply to a second position in which the electrostatic charge generating device is allowed to receive power from the power supply.

DETAILED DESCRIPTION

Figure 1:
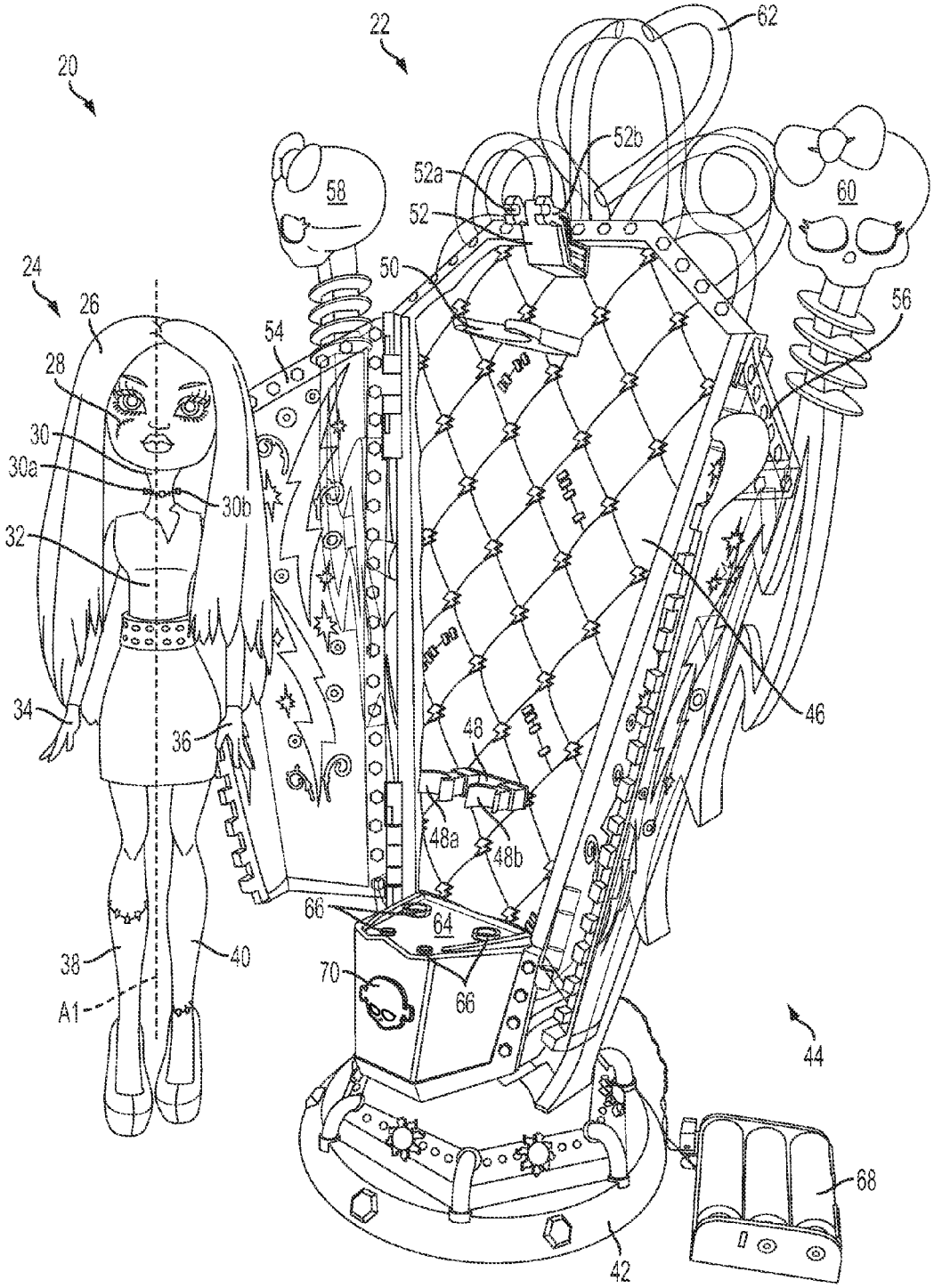
FIG. 1 is a front-side view of a playset including a stand in accordance with an embodiment for supporting a doll.

FIG. 1 is a front-side view of a toy playset 20 in accordance with an embodiment including a stand 22 for supporting a doll 24. As shown, the doll 24 includes hair 26, a head 28, a neck portion 30, a torso 32, arms 34 and 36, and legs 38 and 40. The hair 26 may be made of a substantially non-antistatic material, such as untreated synthetic fiber. In some embodiments, the hair 26 is made of Saran. In some embodiments, the hair 26 is made of Kanekalon®. The hair 26 is connected to the head 28, for example, by rooting the hair 26 into the head 28. The neck portion 30 connects the head 28 to the torso 32, in some embodiments via an articulated neck joint. As shown, the arms 34 and 36 are connected to an upper portion of the torso 32, and the legs 38 and 40 are connected to a lower portion of the torso 32. The doll 24 includes an elongate axis A1 extending through the doll 24 from an upper portion to a lower portion of the doll 24. The neck portion 30 may include one or more protrusions, such as protrusions 30*a* and 30*b*. The protrusions 30*a* and 30*b* may have a visual appearance of metallic bolts. In some embodiments, the protrusions 30*a* and 30*b* may be actual metallic bolts. As shown, the neck portion 30 includes the two protrusions 30*a* and 30*b* projecting from opposite sides of the neck portion 30.

The stand 22 includes a base 42 connected to a supporting structure 44. The supporting structure 44 includes a housing 46, a first yoke (or clip) 48, a second yoke (or clip) 50, a third yoke (or clip) 52, a first door panel 54, a second door panel 56, and one or more projections 58, 60, and 62.

The first yoke 48, the second yoke 50, and the third yoke 52 may be configured to clasp, grasp, clamp, hold, contact, receive, and/or support different portions of a doll, such as the doll 24. As illustrated, the first yoke 48 includes a first yoke portion 48*a* and a second yoke portion 48*b* that may be configured to clasp the legs 38 and 40 of the doll 24. The second yoke 50 may be configured to clasp the torso 32 of the doll 24. The third yoke 52 may be configured to clasp the neck portion 30 of the doll 24. As shown, the third yoke 52 includes a first yoke portion 52*a* and a second yoke portion 52*b* that may be configured to clasp one of the protrusions 30*a* and 30*b* of the neck portion 30. The third yoke 52 may be conductive, such that it is a conductive member. For example, the third yoke 52 may be manufactured with a plastic impregnated with a conductive material (e.g., carbon-impregnated plastic), or coated with an ink impregnated with a conductive material (e.g., carbon-impregnated ink). As illustrated, each of the yokes is configured as a "C"-clip, such that a "C"-shaped portion of the clip slides around and removably retains a portion of the doll 24.

In some embodiments, the various yokes may be described as jaws, claws, members, supporting members, and/or clamps. The third yoke 52 may be called an upper yoke 52 for clasping an upper portion of the doll 24 near a head of the doll 24. The first yoke 48 and the second yoke 50 may be respectively called a first lower yoke 48 and a second lower yoke 50 for respectively clasping lower portions of the doll 24 opposite the head of the doll 24.

FIG. 1 shows the doll 24 in an unsupported position. In other words, FIG. 1 shows the doll 24 not supported by the stand 22. The unsupported position may correspond to the doll 24 being removed from or being in a position apart from the stand 22. Moving the doll 24 from the unsupported position to a supported position (see FIG. 6) in the stand 22 may involve a user positioning a bottom portion of the doll 24 on a platform 64 of the housing 46, positioning the legs 38 and 40 in the first yoke 48, positioning the torso 32 in the second yoke 50, and positioning the neck portion 30 in the third yoke 52. Once the doll 24 is in the supported position, the user may selectively move door panels 54 and 56 from the open position (shown in FIG. 1) to a closed position (shown in FIG. 6).

Figure 4:
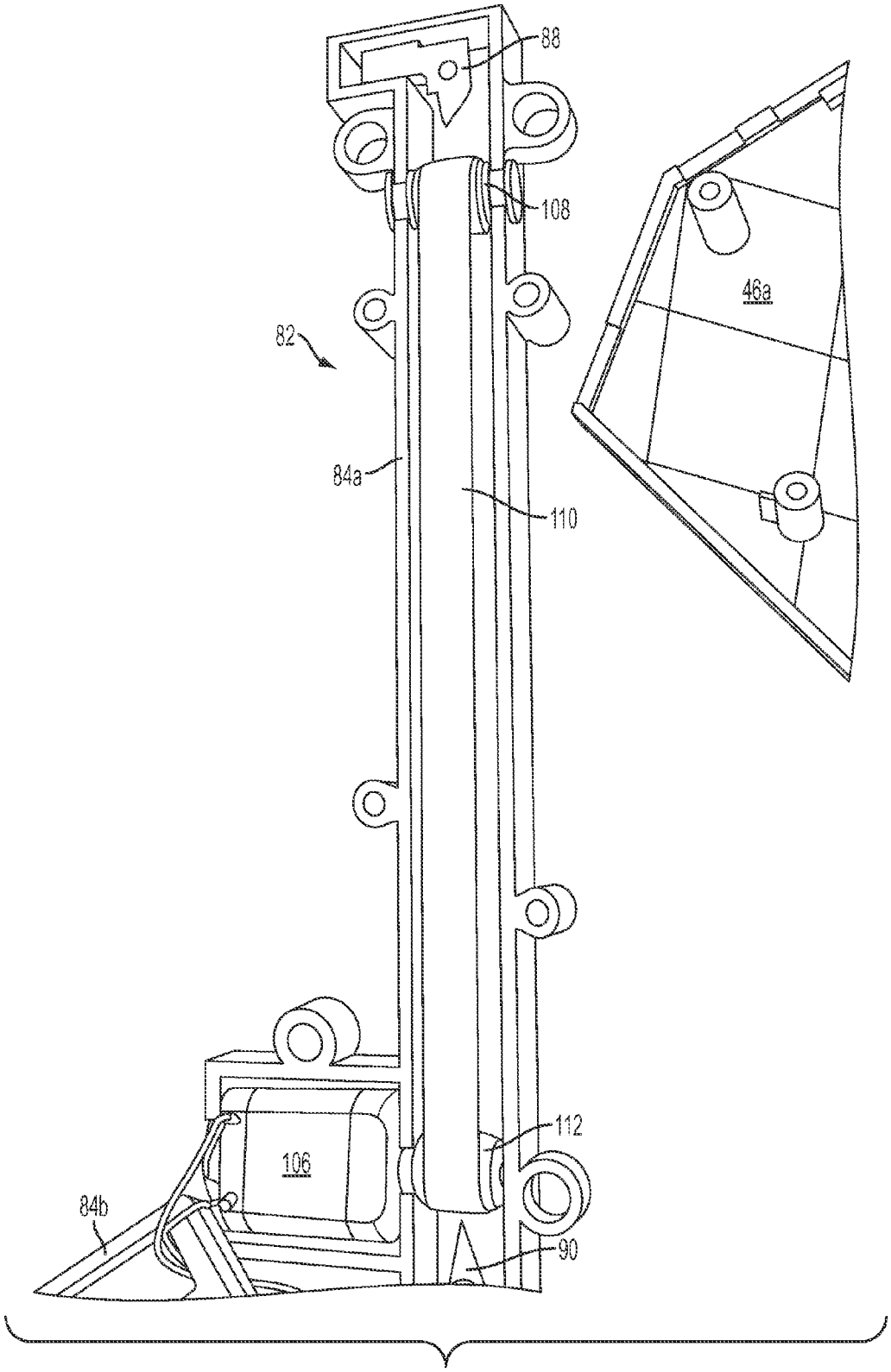
FIG. 4 is an inside view of the electrostatic charge generating device of the stand of FIGS. 1-3 in accordance with an embodiment.

With reference to FIGS. 1 and 4, the stand 22 may include an electrostatic charge generating device 82, such as a Van de Graaff generator. The electrostatic charge generating device 82 may be configured to produce an electrostatic charge. A portion of the stand 22 may be configured to directly transmit the produced electrostatic charge to a portion of the doll 24 that is proximate to and/or supported by the stand 22. For example, the upper yoke 52 may be electrically connected to a charge-collecting portion (or static-electricity connector) of the electrostatic charge generating device 82 (e.g., the upper yoke 52 may be electrically connected to a first electrode 88 of a Van de Graaff generator). The upper yoke 52 (and/or any of the other yokes) may be a conductive member or connector. For example, the upper yoke 52 may be made of an electrically conductive material, such as carbon-impregnated plastic, or the upper yoke 52 may be coated with an electrically conductive material, such as a carbon-impregnated ink. The electrostatic charge generating device 82 may be connected to the stand 22. For example, the electrostatic charge generating device 82 may be housed in the housing 46, and/or connected to a rear portion of the supporting structure 44.

The stand 22 may include one or more light sources (e.g., LEDs 66), a power supply 68 (e.g., one or more batteries, such as three AA batteries), and an activation mechanism (e.g., button 70). The power supply 68 may be housed in the housing 46 and may be connected to the LEDs 66 and to the electrostatic charge generating device 82. Actuation of the button 70 may be configured to simultaneously energize the LEDs 66 and activate or operate the electrostatic charge generating device 82 to produce the electrostatic charge, which may result in illuminating the doll 24 by the LEDs 66 and levitating the hair 26 of the doll 24 by the electrostatic charge when the doll 24 is in the supported position.

Figure 2:
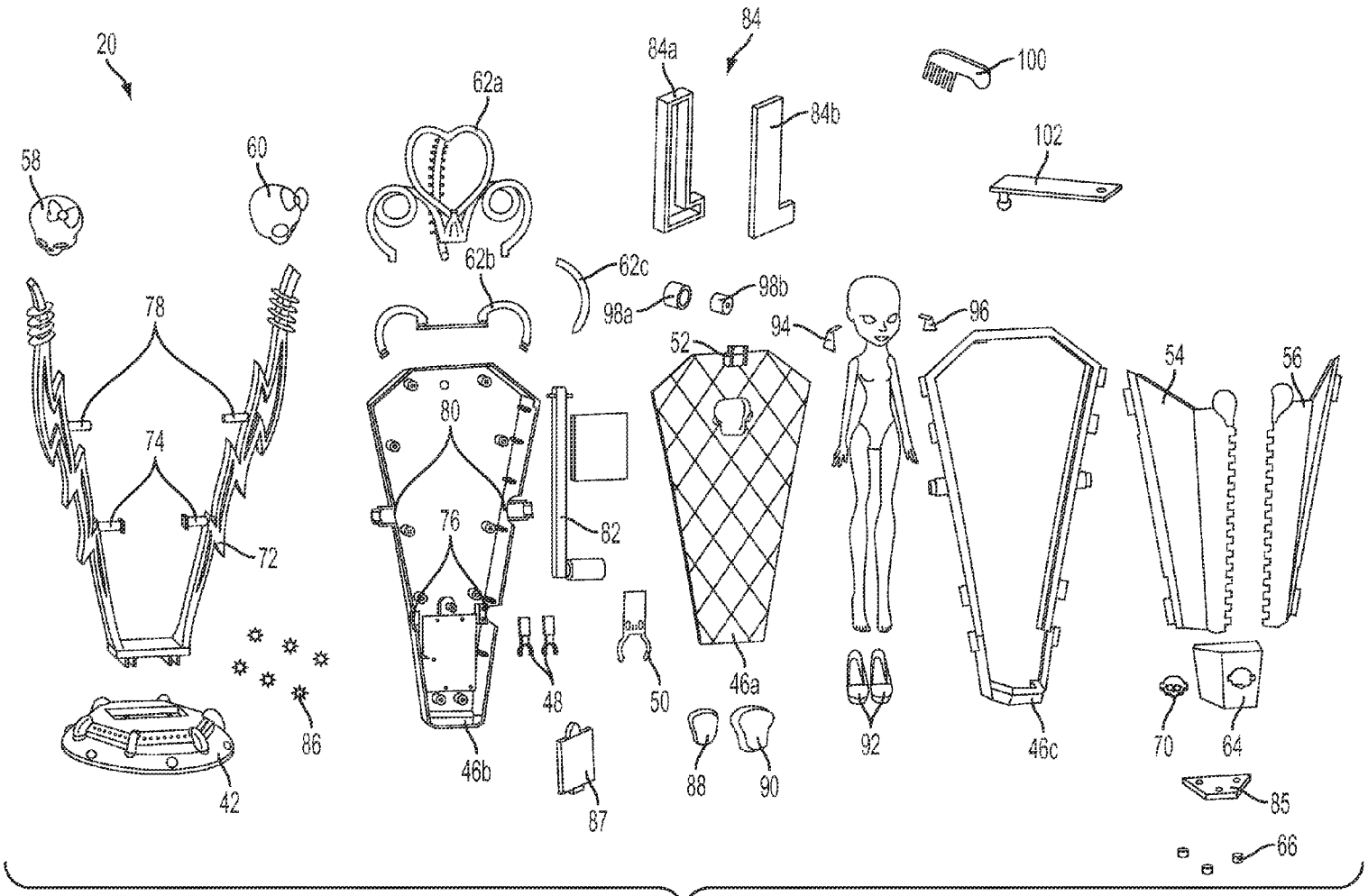
FIG. 2 shows an exploded view of the playset of FIG. 1 in accordance with an embodiment.

FIG. 2 shows an exploded view of the playset 20 in accordance with an embodiment. With reference to FIGS. 1 and 2, the supporting structure 44 includes an upright member 72 connected to the base 42. The housing 46 connects to and/or is supported by the upright member 72. For example, a lower pair of tabs 74 of the upright member 72 extend into a lower pair of recesses 76 of the housing 46, and an upper pair of tabs 78 extend into an upper pair of recesses 80 of the housing 46. As shown, the upright member 72 includes portions that resemble one or more lightning bolts. Projections 58 and 60 connect to end portions of the lightning bolts.

The electrostatic charge generating device 82, which may be, for example, a Van de Graaff generator, may be disposed in a sub-housing 84. For example, the electrostatic charge generating device 82 may be disposed in a recess of a box portion 84*a* of the sub-housing 84, and a lid portion 84*b* of the sub-housing 84 may be connected to the box portion 84*a* to substantially contain the electrostatic charge generating device 82 between the box 84*a* and the lid 84*b*.

The electrostatic charge generating device 82 (contained in the sub-housing 84) may be disposed between a front housing portion 46*a* and a rear housing portion 46*b* of the housing 46. A housing portion frame 46*c* of the housing 46 may frame a perimeter of the front housing portion 46*a* and the rear housing portion 46*b*. The platform 64 connects to a lower portion of the rear housing portion 46*b*. The door panels 54 and 56 connect to opposite portions of the housing frame portion 46*c*. Portions 62*a*, 62*b*, and 62*c* of the projection 62 connect with one another and/or connect to an upper portion of the housing 46. The platform 64 of the housing 46 includes a plate 85 in which the LEDs 66 are disposed.

The playset 20 may include electricity-related representations 86 (e.g., depictions of electrical flashes and/or lightning bolts) connected to the base 42, a battery housing door 87, a first conductive electrode (or brush) 88 and a second conductive electrode (or brush) 90 of the electrostatic charge generating device 82, a pair of shoes 92 for the doll 24, earrings 94 and 96 connectable to ears of the head of the doll 24, a first portion 98*a* and a second portion 98*b* of a motor cover for a motor of the electrostatic charge generating device 82, a comb 100 for combing the hair 26 of the doll 24, and a static electricity connector 102 for transmitting the electrostatic charge from the first electrode 88 of the electrostatic charge generating device 82 to the upper yoke 52 (e.g., the static electricity connector 102 may be electrically connected to the first electrode 88 disposed inside the housing 46, and may be electrically connected to the upper yoke 52).

Figure 3:
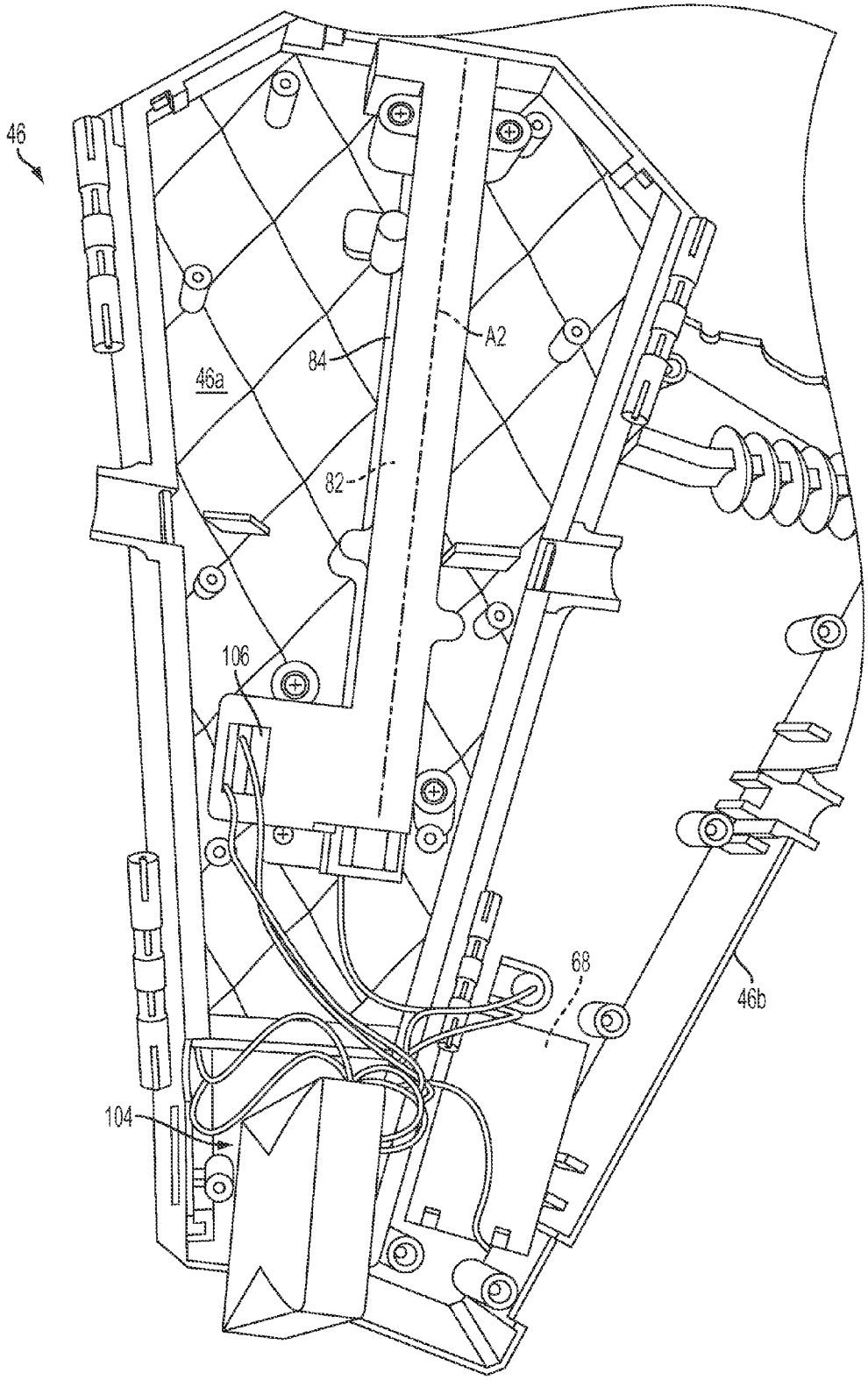
FIG. 3 is a back view of the stand of FIG. 1 with a housing of the stand open to show internal components including a sub-housing for an electrostatic charge generating device in accordance with an embodiment.

FIG. 3 shows a rear view of the housing 46 in accordance with an embodiment, with the rear housing portion 46*b* removed to show internal components. The sub-housing 84 contains a substantial portion of the electrostatic charge generating device 82 and substantially isolates the electrostatic charge generating device 82 from the remainder of the housing 46. The sub-housing 84 is attached to the front housing portion 46*a* with screws. The electrostatic charge generating device 82 may have a long axis A2, as indicated, that extends in an elongate direction of the housing 46 and the sub-housing 84.

With reference to FIGS. 1 and 3, the playset 20 may include other suitable electrical or electronic components, such as an on/off switch for controlling and/or enabling one or more operations of the playset. For example, the playset 20 may include a printed circuit board assembly (PCBA) 104, which may be disposed in the housing 46. The power supply 68, the LEDs 66 in the platform 64, and the motor 106 of electrostatic charge generating device 82 may be electrically connected to the PCBA 104. In some embodiments, the playset 20 includes a speaker connected to the PCBA 104. The PCBA 104 may include a microcontroller (or other suitable circuitry) for controlling one or more operations of the playset 20. For example, the microcontroller may be configured to control the power sent from the power supply 68 to the motor 106 and to the LEDs 66 when the button 70 is pressed.

FIG. 4 shows the box portion 84*a* removed from the front housing portion 46*a*, and also shows the lid portion 84*b* (shown more fully in FIG. 2) removed from the box portion 84*a* to expose the electrostatic charge generating device 82, which may be, for example, a Van de Graaff generator. The electrostatic charge generating device 82 includes the first electrode 88, a first pulley (or roller) 108, a belt 110, a second pulley (or roller) 112, and the second electrode 90. The motor 106 is connected to an axle of the second pulley 112, and the belt 110 is looped around the first pulley 108 and the second pulley 112. In various embodiments, the first electrode 88 may be electrically connected to the upper yoke 52 (see FIG. 1), and the second electrode 90 may be substantially electrically grounded. The motor 106 drives the second pulley 112 about an axle of the second pulley 112, which transmits rotational power to the first pulley 108 via the belt 110. In other words, rotation of the second pulley 112 drives the belt 110 around the first pulley 108, which causes rotation of the first pulley 108 about an axle of the first pulley 108.

Movement of the belt 110 around the first pulley 108 and the second pulley 112 produces an electrostatic charge. The first electrode 88 collects the electrostatic charge. In various embodiments, the first electrode 88 also transmits the collected electrostatic charge to the upper yoke 52 (see FIG. 1). Thus, turning on the motor 106 drives the belt 110 to produce an electrostatic charge in the upper yoke 52. As the motor 106 moves the belt 110, friction may occur between the belt 110 and the first pulley 108, and between the belt 110 and the second pulley 112. Materials for the belt 110, the first pulley 108, and the second pulley 112 may be selected such that a static charge is generated by a triboelectric effect and passed to the first electrode 88 via the belt 110. For example, the first pulley 108 may be made of a conductive material, such as aluminum. The belt 110 may be made of a dielectric material, such as silicone rubber. The second pulley 112 may be made of an insulating material, such as nylon. The first electrode 88 may include one or more pointed portions for collecting the electrostatic charge. The one or more pointed portions may be disposed proximate the first pulley 108. As shown, the first electrode 88 includes one pointed portion disposed proximate the first pulley 108, but not in contact with the belt 110.

Figure 5:
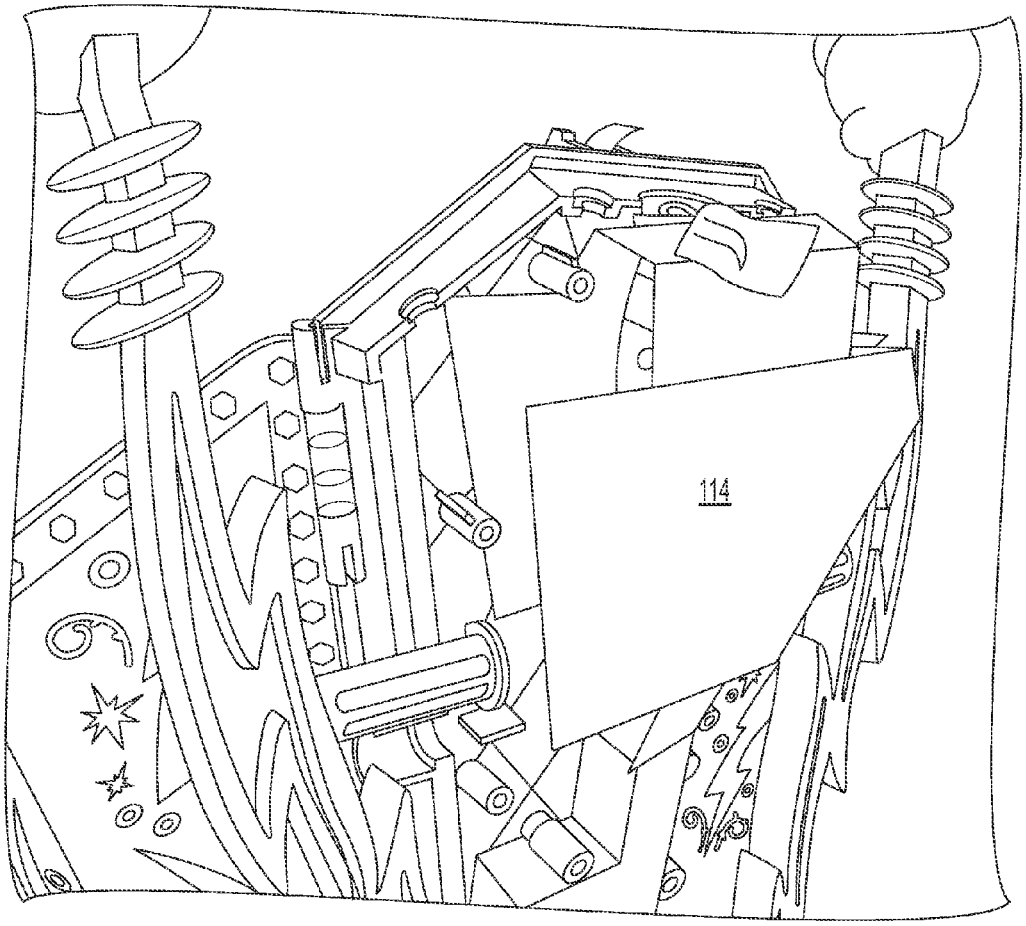
FIG. 5 is a back-side view of the stand of FIG. 1 with a housing of the stand open to show internal components including a conductive electrode surrounding an upper portion of the electrostatic charge generating device in accordance with an embodiment.

FIG. 5 is a back-side view of the stand 20 of FIG. 1 with the housing 46 of the stand 20 open to show internal components. With reference to FIGS. 3, 4, and 5, a marginally conductive electrode (or collector) 114 is shown disposed around an upper portion of the electrostatic charge generating device 82. In this example, the marginally conductive electrode is shown disposed around the first electrode 88 and the first pulley 108. The first electrode 88 may be electrically connected to the marginally conductive electrode 114. The marginally conductive 114 electrode may be a charged electrode. For example, the electrode may be configured to store the generated static charge to create a relatively large static voltage between the grounded second electrode 90 and the marginally conductive electrode 114. The marginally conductive electrode 114 may include paper (or cardboard).

Figure 6:
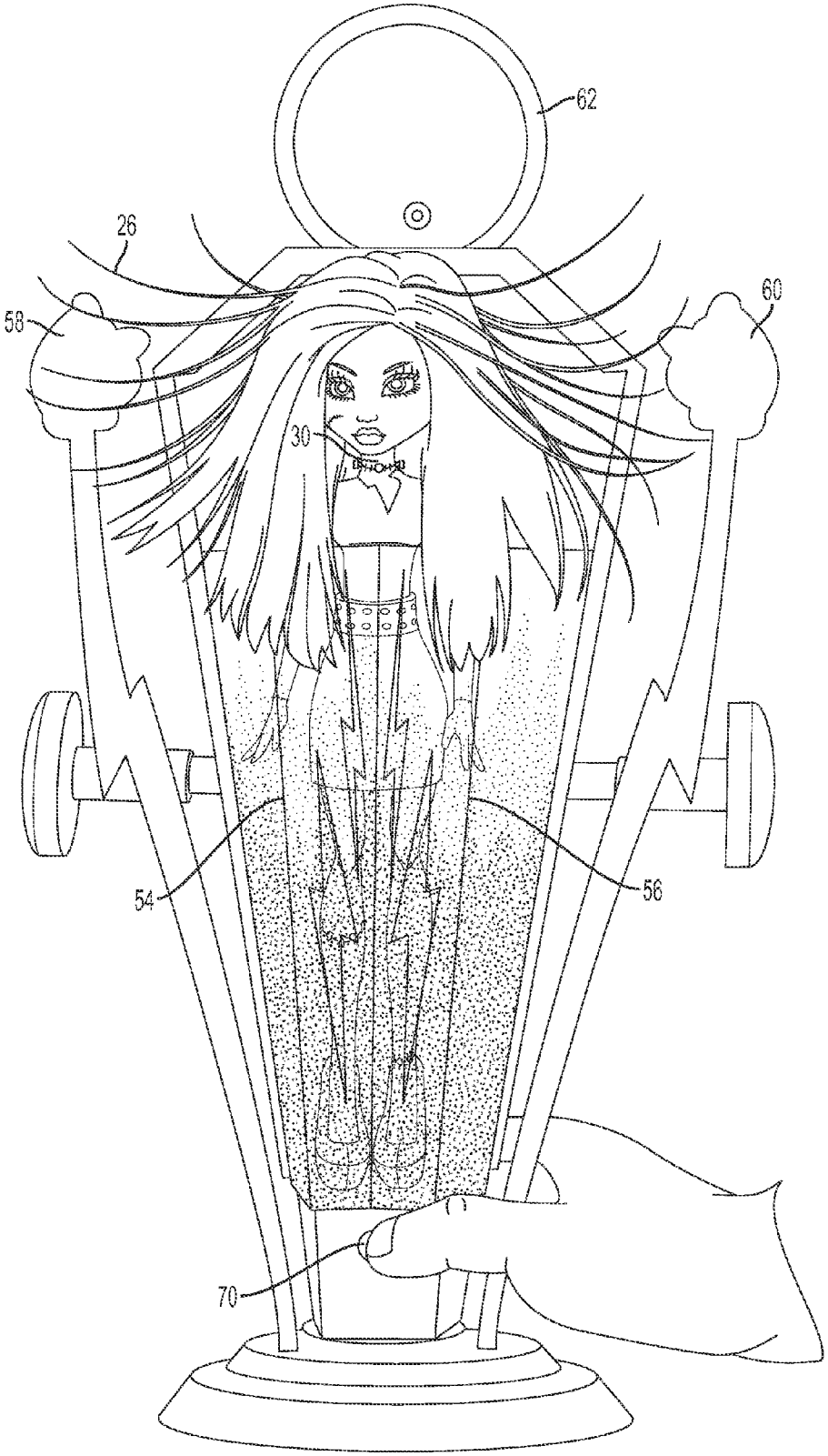
FIG. 6 is a front view of the playset of FIG. 1 with a user operating the stand to levitate hair of the doll in accordance with an embodiment.

FIG. 6 shows the doll 24 of FIG. 1 in the supported position, and the door panels 54 and 56 in the closed position. With reference to FIGS. 1, 3, 4, and 6, when the doll is in the supported position of FIG. 6, the supporting structure 44 holds the doll 24 in a first orientation. The first orientation may correspond to the doll 24 positioned vertically adjacent to the electrostatic charge generating device 82, with an elongate axis of the doll 24 substantially parallel to a long axis of the electrostatic charge generating device 82. The first orientation may place the hair 26 of the doll 24 in proximity to the first electrode 88 of the electrostatic charge generating device 82, which may improve transmission, or at least decrease loss, of an electrostatic charge to the hair 26 and may provide for a compact design.

A user can press the button 70 to actuate the playset 20 (such as in FIG. 6). Actuation of the playset 20 may result in operation of the electrostatic charge generating device 82 to produce an electrostatic charge. The electrostatic charge may be collected by the first electrode 88 of the electrostatic charge generating device 82. The first electrode 88 may be electrically connected to the upper yoke 52 of the stand 22. The upper yoke 52 may transmit the electrostatic charge to protrusions of the neck portion 30 of the doll 24. The electrostatic charge may be transmitted from the neck portion 30 to the hair 26 (e.g., via conductive pathways in, on, or around the head of the doll 24), which may result in levitation or lift of the hair 26. Actuation of the playset 20 may also involve the LEDs 66 illuminating the door panels 54 and 56. For example, the door panels 54 and 56 may be made of light-transmitting material and may include etched depictions of lightning bolts, which the LEDs 66 may illuminate when lit. In embodiments that include a speaker, actuation of the playset 20 may be configured to emit one or more sounds (e.g., music and/or sound effects) through the speaker.

In some embodiments, the button 70 may function as an on/off switch. For example, pressing the button 70 may actuate the playset 20, and the playset 20 may remain activated until the button 70 is pressed again. In other embodiments, pressing and releasing the button 70 may actuate the playset 20 for a predetermined amount of time, after which the playset 20 may deactivate until the button 70 is subsequently pressed. In other embodiments, the playset 20 may actuate when the button 70 is pressed, and deactivate when the button 70 is released. In some embodiments, the playset 20 may be configured to deactivate after a predetermined amount of time (e.g., the microcontroller may turn off the electrostatic charge generating device 82 after 15 seconds even through a user may not have released the button 70).

Figure 7A:
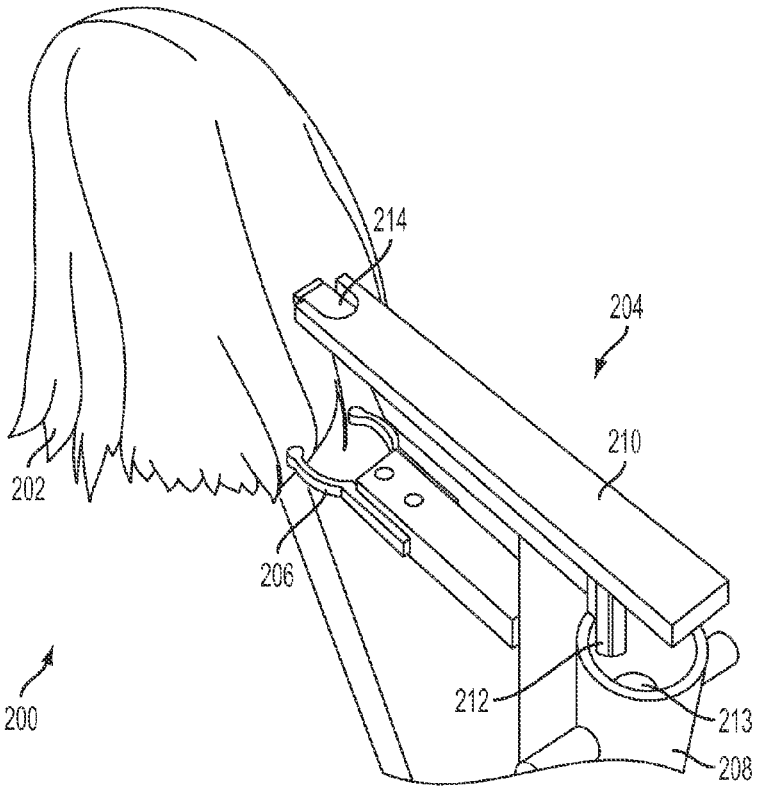
FIG. 7A illustrates a portion of a stand including a static electricity collector and a head of the doll away from the static electricity collector in accordance with an embodiment.

FIG. 7A shows a portion of a playset 200 in accordance with an embodiment that includes a mechanism configured to prevent inadvertent electrical shock of a user. The playset 200 may include one or more components of any of the playsets disclosed herein. For example, the playset 200 may include an electrostatic charge generating device disposed in a housing similar to the electrostatic charge generating device 82 disposed in the housing 46 (see FIGS. 1 and 2), which may be a Van de Graaff generator. As shown in FIG. 7A, the playset 200 includes a doll 202 and a stand 204 including a yoke 206 (similar to the second yoke 50 of FIG. 1), a Van de Graaff generator disposed in a housing 208, and a static electricity connector 210 electrically connected to a first electrode 212 of the Van de Graff generator.

FIG. 7A shows the doll 202 in an unsupported position. A distal end 214 of the connector 210 may include conductive plastic for contacting the doll 202 (e.g., when the doll 202 is moved to a supported position such as in FIG. 7B). The distal end 214 may be electrically connected to the first electrode 212. The connector 210 may be moved between a distal position (shown in FIG. 7A) and a proximate position (shown in FIG. 7B). The connector 210 may be biased to the distal position by a spring that applies a force on the connector 210 away from the proximate position. The distal position may correspond to a position where the electrode 212 is relatively distant from a belt 213 of the Van de Graaff generator to prevent or hinder a transfer of charge from the Van de Graaff generator to the connector 210. For example, FIG. 7A shows the electrode 212 disposed in a recess of the housing 208 when the connector 210 is in the distal position.

Figure 7B:
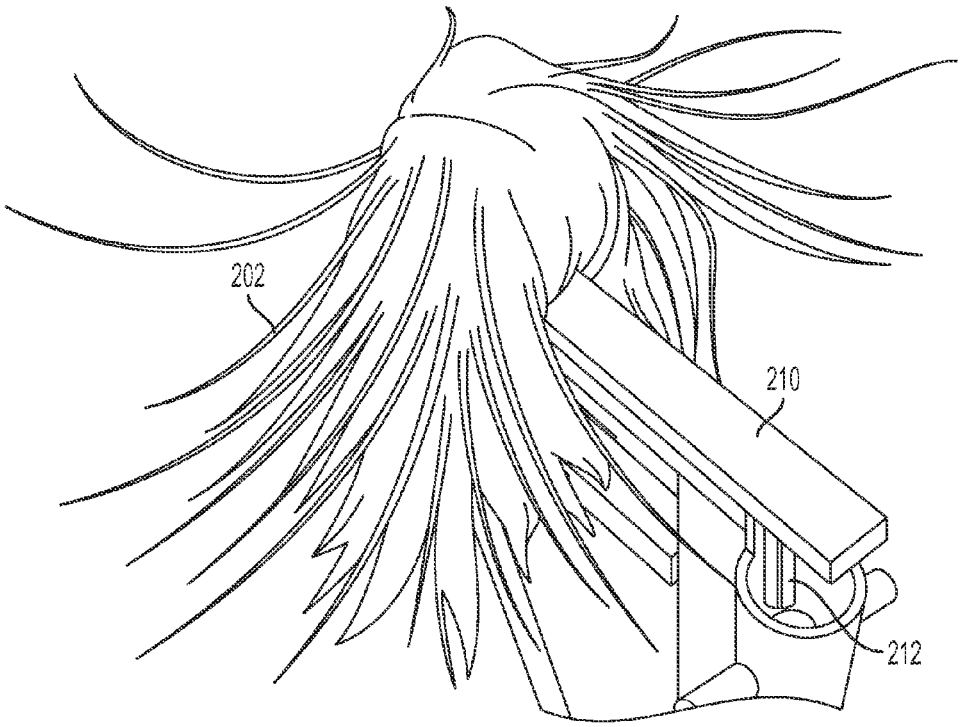
FIG. 7B illustrates the portion of the stand of FIG. 7A with the head of the doll in contact with the static electricity collector in accordance with an embodiment.

FIG. 7B shows the doll 202 moved to the supported position, which may compress the spring and move the connector 210 to the proximate position. The proximate position may correspond to a position where the electrode 212 is close to the belt of the Van de Graaff generator to promote the transfer of charge from the Van de Graaff generator to the connector 210. As shown in FIG. 7B, when the doll 202 is in the supported position to cause the connector 210 to be in the proximate position, the playset 200 may be configured to raise the hair of the doll 202 (e.g., via a generated electrostatic charge from the Van de Graaff generator). If the doll 202 is subsequently removed from the supported position (e.g., to the unsupported position), then the spring may push the connector 210 back to the distal position (see FIG. 7A).

Figure 8:
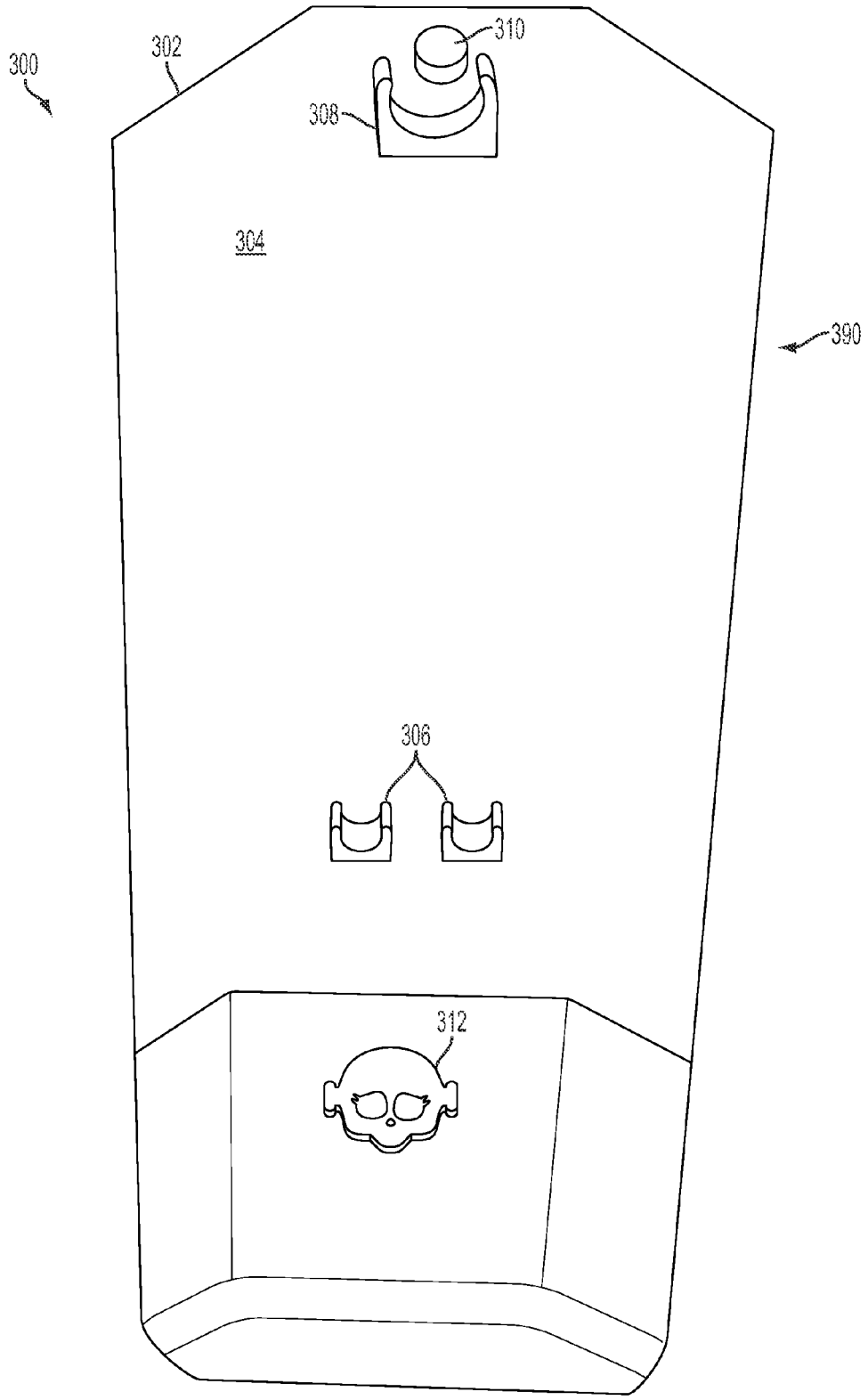
FIG. 8 is a front view of a stand including a conductive member in accordance with an embodiment.

FIG. 8 shows a playset 300 in accordance with an embodiment. The playset 300 may include one or more components of any of the playsets disclosed herein, such as one or more components of the playset 20 of FIGS. 1-6. As shown in FIG. 8, the playset 300 includes a doll stand 302 including a housing 304 (similar to the housing 46 of FIGS. 1 and 2), a lower yoke (or clip) 306 for supporting or grasping legs of a doll (similar to the first yoke 48 for grasping the doll 24 of FIG. 1), an upper yoke (or clip) 308 for supporting or grasping an upper portion of a doll, such as a waist portion or neck portion of a doll (similar to the second yoke 50 of FIG. 1), a conductive (or substantially conductive) member or connector 310 protruding from the housing 304, and a button 312, which may be made of a conductive material (e.g., carbon-impregnated plastic).

A doll, such as the doll 24 of FIG. 1 may be positioned in the stand 302 of FIG. 8 in a supported position similar to the supported position of FIG. 6, with the yokes 306 and 308 of the stand 302 of FIG. 8 holding the doll. The doll may contact the conductive member 310, and may depress the conductive member 310 to a proximate position when the doll is in the supported position. A user may actuate the playset 300 by pressing the button 312 to turn on an electrostatic charge generating device, such as a Van de Graff generator, which may be disposed in the housing 304. The electrostatic charge generating device may be configured to generate an electrostatic charge and transfer the generated electrostatic charge to the doll via the conductive member 310 to raise (or levitate) the hair of the doll.

Figure 9:
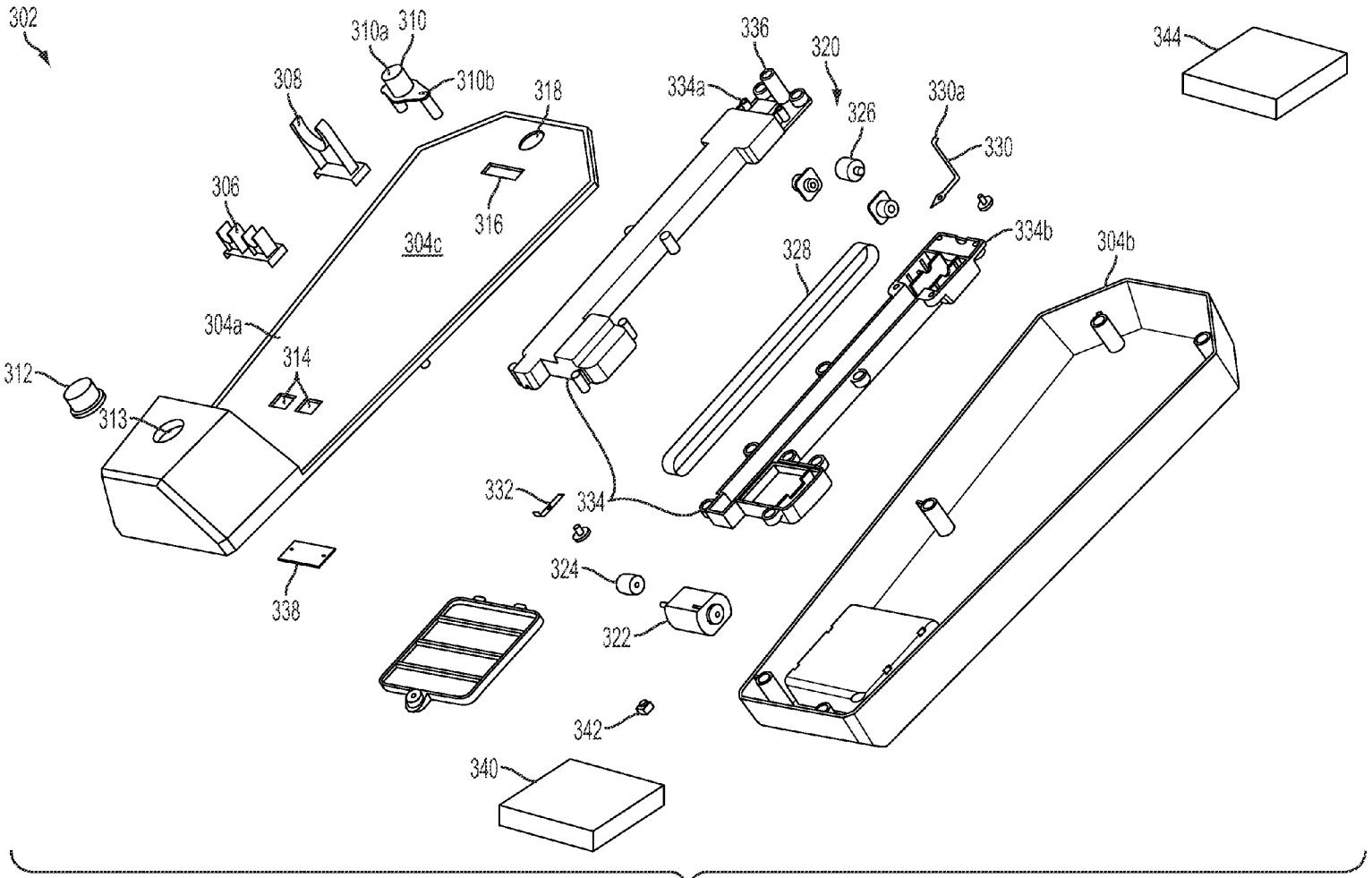
FIG. 9 is a front exploded view of the stand of FIG. 8 in accordance with an embodiment.
Figure 10:
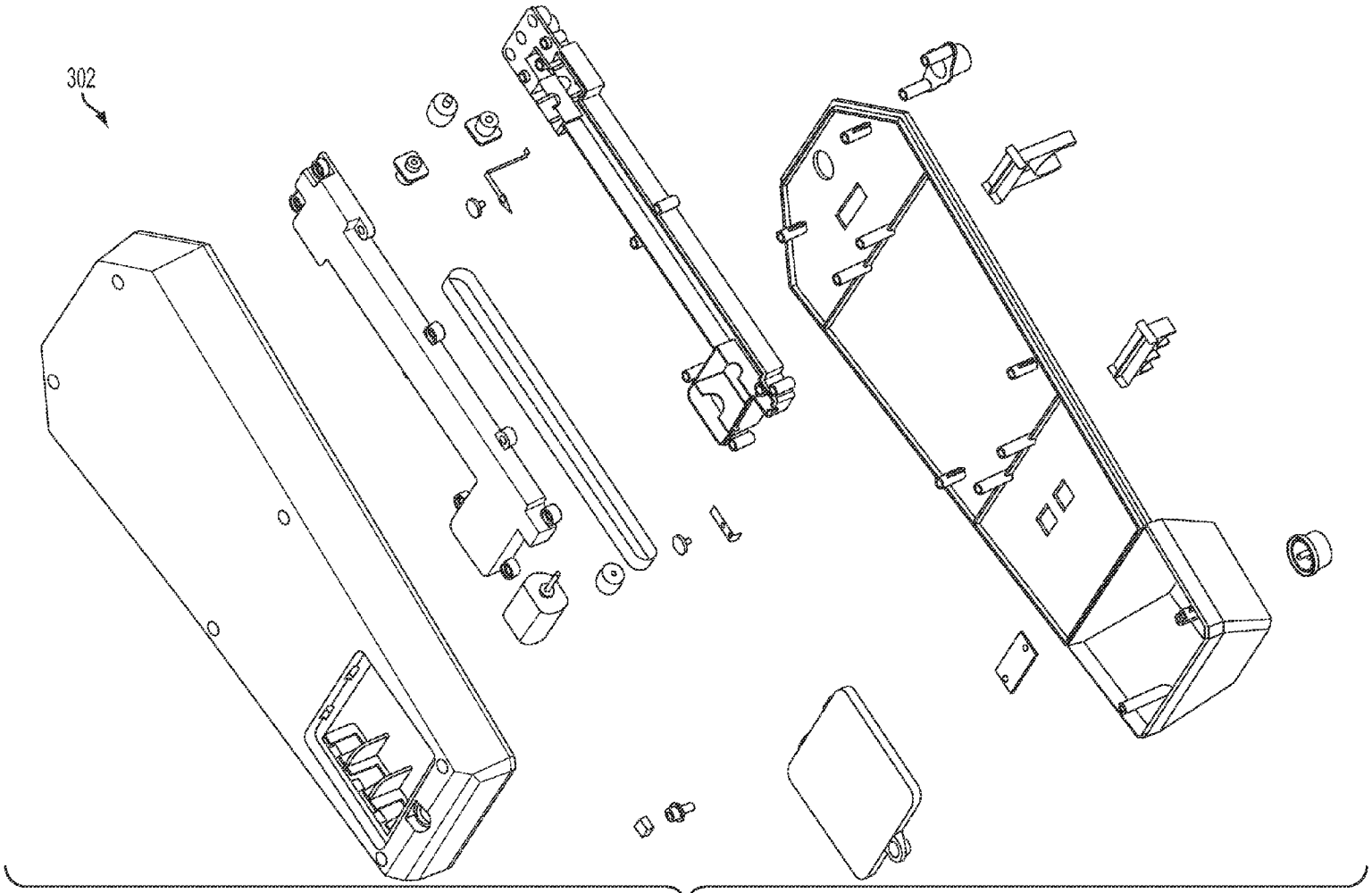
FIG. 10 is a rear exploded view of the stand of FIG. 8 in accordance with an embodiment.

FIGS. 9 and 10 show exploded schematic views of the doll stand 302 in accordance with an embodiment. With reference to FIGS. 8, 9, and 10, the housing 304 may include a front housing portion 304*a* and a rear housing portion 304*b*. The button 312 may be disposed in an aperture 313 of the front housing portion 304*a*, and in some embodiments the button 312 includes carbon. The lower yoke 306 may extend through (or protrude from) one or more lower apertures 314 in the front housing portion 304*a*, and may serve, for example, as a clip for the legs of a doll. The upper yoke 308 may extend through (or protrude from) an upper aperture 316 of the front housing portion 304*a*, and may serve, for example, as a clip for a neck of a doll. The conductive member 310 may be an electrically conductive connector made of or impregnated with carbon or other conductive material. A distal end 310*a* of the conductive member 310 may protrude from an aperture 318 in a front face 304*c* of the front housing portion 304*a*, and a proximate end 310*b* of the conductive member 310 may be retained between the front housing portion 304*a* and the rear housing portion 304*b*. In some embodiments, the lower yoke 306 may be made of substantially non-conductive materials (e.g., plastic that is not impregnated with carbon).

As shown in FIGS. 9 and 10, the stand 302 includes an electrostatic charge generating device 320, such as a Van de Graff generator, including a motor 322, a lower pulley 324, an upper pulley 326, a belt 328, an upper plate or first electrode 330 (e.g., made of copper or other conductive material), and a lower plate or second electrode 332 (e.g., made of copper or other conductive material). In various embodiments, the lower pulley 324 and the upper pulley 326 generate high triboelectric charge of opposite charges. In some embodiments, the lower pulley 324 is made of Teflon and the upper pulley 326 is made of Nylon or aluminium. In various embodiments, the belt 328 is made of a material that is between the materials of the lower pulley 324 and the upper pulley 326 on the triboelectric scale. Also, in various embodiments, the material used for the belt 328 is an excellent dielectric so that it can hold static charge well. For example, in some embodiments the belt 328 is made of natural rubber. In some embodiments, the belt 328 is made of silicone rubber. The materials discussed above for the lower pulley 324, the upper pulley 326, and the belt 328 are merely provided as examples, and in various other embodiments those components may be made of any suitable materials for generating an electrostatic charge.

The electrostatic charge generating device 320 may be disposed in a sub-housing 334, between front and rear sub-housing portions 334*a* and 334*b*. The sub-housing 334 may be disposed in the housing 304 and may be attached to one or both of the front housing portion 304*a* and the rear housing portion 304*b*. The first electrode 330 includes an arm 330*a* that extends through an elongate aperture (or sleeve) 336 of the front sub-housing portion 334*a*. The arm 330*a* may protrude out of the sub-housing 334 toward the conductive member 310. As shown, the stand 302 further includes a printed circuit board assembly (PCBA) 338, a first covering 340 (e.g., a first paper box including foil or other conductive element to create a Faraday cage), a tact switch 342, and a second covering 344. In various embodiments, the second covering 344 serves as an electrode. In some embodiments, the second covering 344 is made of conductive material such as metal foil, metallized plastic, foil covered paper, or the like. In some embodiments, the second covering 344 includes a paper box. In some embodiments, the second covering 344 is made of a marginally conductive material that allows for moderate leakage of an electric field.

Figure 11A:
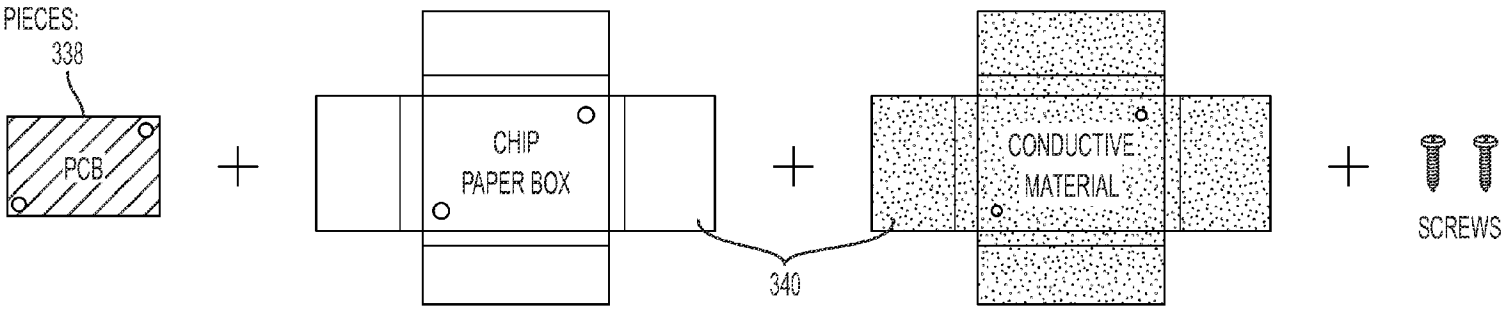
FIG. 11A is a plan view of components for protecting a printed circuit board assembly (PCBA) of the stand of FIG. 8 in accordance with an embodiment.
Figure 11B:
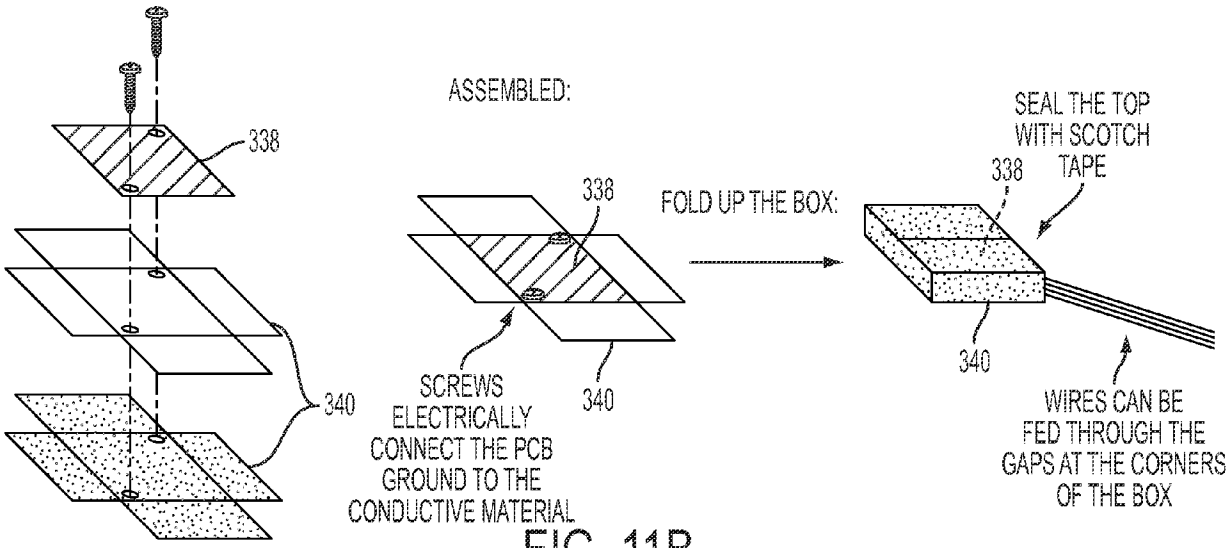
FIG. 11B illustrates the components of FIG. 11A in various states of assembly in accordance with an embodiment.

FIGS. 11A and 11B illustrate an embodiment of the PCBA 338 being disposed in the first covering 340. With reference to FIGS. 9, 11A, and 11B, in various embodiments the first covering 340 protects the PCBA 338 from being damaged by electrostatic charge generated by the electrostatic charge generating device 320, which may be as high as 12-15 kV. In various embodiments, the first covering includes a paper box and a conductive material that are joined together, and the PCBA 338 may be grounded to the conductive material of the first covering 340. In some embodiments, the conductive material of the first covering 340, the second electrode 332, and the button 312 are electrically connected to a negative contact of a power supply 313 (e.g., one or more batteries—see FIG. 12), or other suitable electrical ground.

FIGS. 11A and 11B show exemplary components for protecting the PCBA 338 (or components thereof, such as a microcontroller) from being damaged by an electrostatic shock. In various embodiments, the first covering 340 forms a Faraday cage surrounding the PCBA 338. For example, the covering 340 may include a chip paper box and a conductive material. As shown, the PCBA 338 may be disposed inside the chip paper box. The conductive material may be disposed on an outside portion of the chip paper box, and one or more attachment members (e.g., screws) may electrically connect an electrical ground of the PCBA 338 to the conductive material. With reference to FIGS. 8, 9, 11B, and 12, wires connecting the PCBA 338 to other components of the stand 302 (e.g., the power supply 313, the tact switch 342, the motor 322, and/or LEDs 346) may be fed through one or more gaps in the first covering 340. One or more seams of the first covering 340 may be sealed (or secured) by tape or any other suitable fastener. In various embodiments, the stand 302 includes a speaker 380 supported by the housing 304 for emitting one or more sounds. In some embodiments, the PCBA 338 is configured to control the one or more sounds emitted from the speaker 380 in response to actuation of the button 312.

Figure 12:
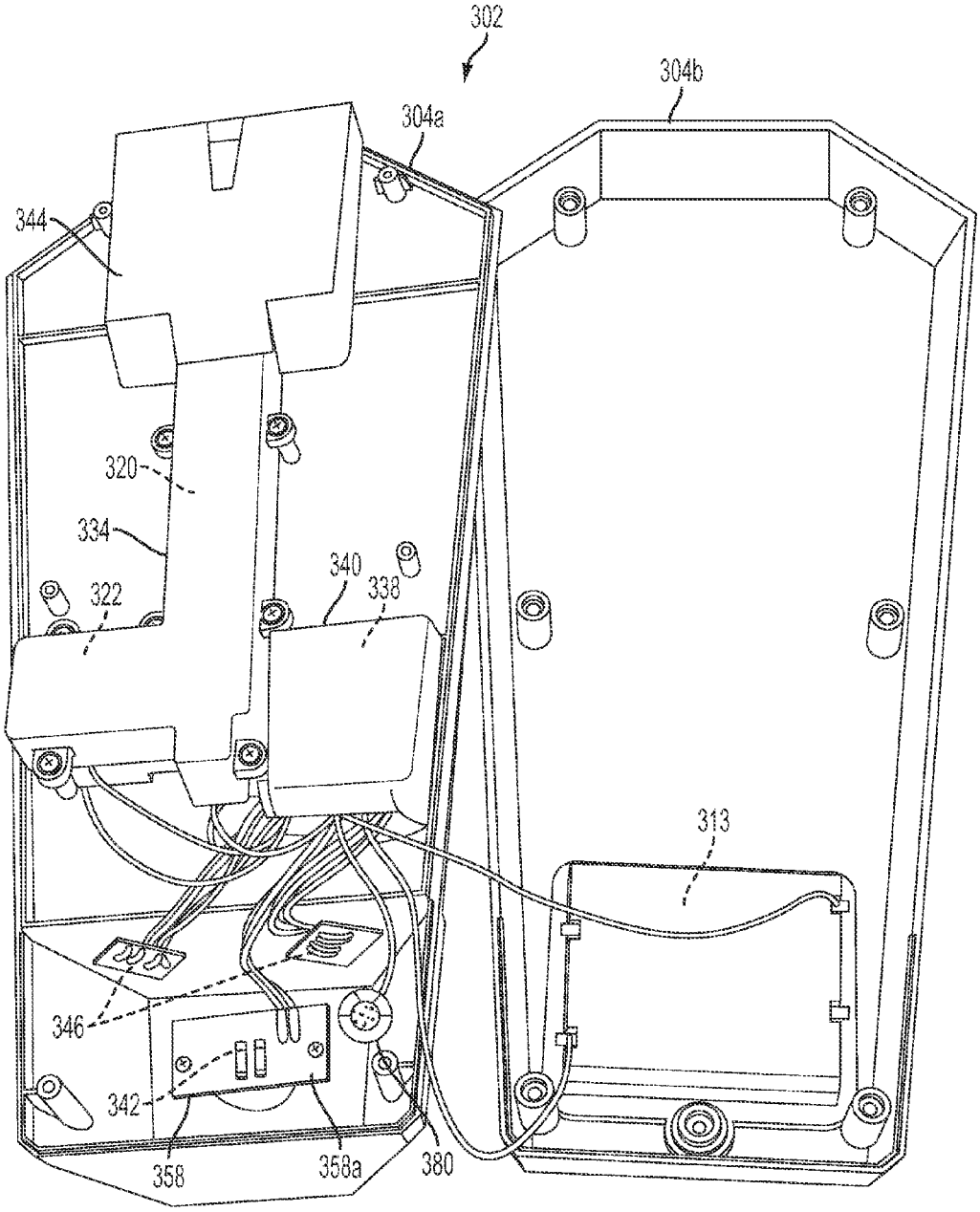
FIG. 12 is a back view of the stand of FIG. 8 with a housing of the stand open to show internal components including a sub-housing of an electrostatic charge generating device and a marginally conductive electrode surrounding an upper portion of the sub-housing.

FIG. 12 is a back view of the stand 302 of FIG. 8 in accordance with an embodiment with the housing including the front housing portion 304*a* and the rear housing portion 304*b* open to show internal components. With reference to FIGS. 9 and 12, in various embodiments an upper portion of the electrostatic charge generating device 320 and/or the sub-housing 334 are disposed in the second covering 344. The second covering 344 may be configured to be a marginally conductive electrode (similar to the marginally conductive electrode 114 of FIG. 5) for collecting electrostatic charge from the first electrode 330 and/or the upper portion of the electrostatic charge generating device 320. In some embodiments, the first electrode 330 may be electrically connected to the second covering 344. The material of the second covering 344 may allow for a gradual (rather than instantaneous) transfer of the generated electrostatic charge to the conductive member 310, which may reduce a likelihood that a user may feel an electric shock if the user touches the conductive member 310.

The stand 302 may operate in a similar fashion as the stand 22 of FIGS. 1-6 and/or the stand 204 of FIGS. 7A and 7B. With reference to FIGS. 8, 9, and 12, the PCBA 338 may be configured to power the motor 322 using the power supply 313 when the button 312 is actuated. The motor 322 may drive the belt 328 via the lower pulley 324. Friction between the belt 328, the lower pulley 324, and the upper pulley 326 may generate an electrostatic charge that is collected by the first electrode 330. The first electrode 330 may collect more electrostatic charge when the first electrode 330 is closer to the belt 328 than when it is farther away from the belt 328.

Figure 13:
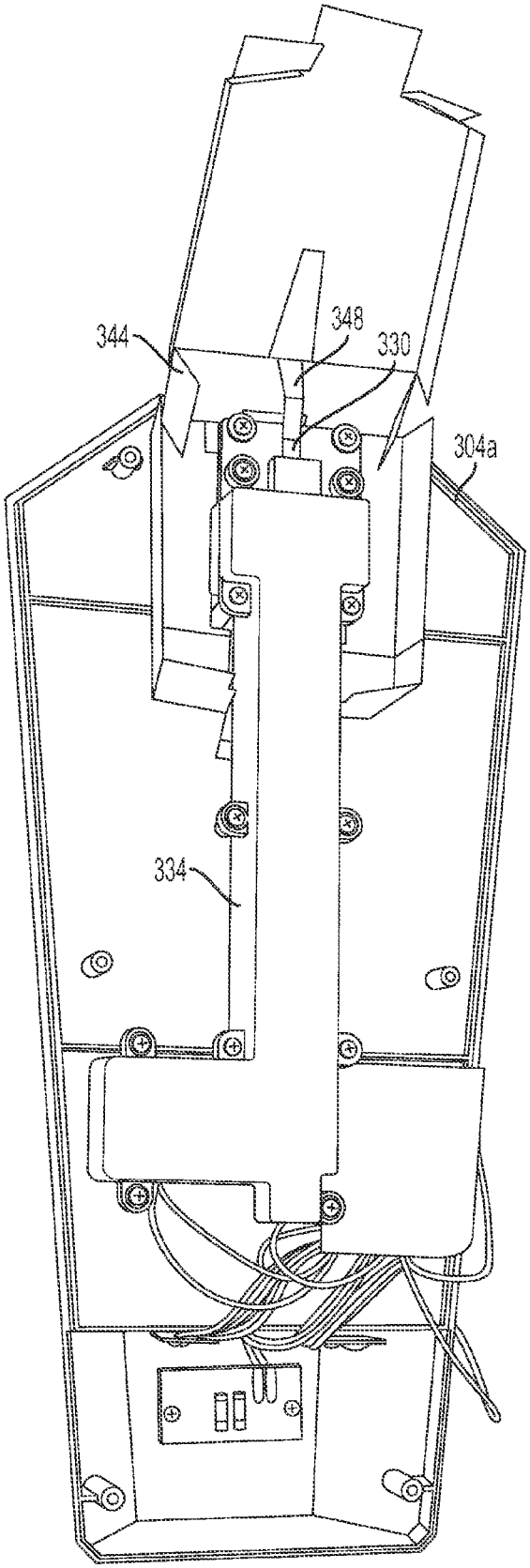
FIG. 13 is a back view of the stand of FIG. 8 with a housing of the stand open to show internal components with the marginally conductive electrode partially unfolded to show a portion of the marginally conductive electrode configured to electrically connect to a first electrode of the electrostatic charge generating device.

In FIGS. 12 and 13, the rear housing portion 304*b* has been separated from the front housing portion 304*a* to show internal components of the stand 302. In various embodiments, the second covering 344 surrounds an upper portion of the sub-housing 334 and an upper portion of the electrostatic charge generating device 320. In some embodiments, the second covering 344 may include chip paper (or cardboard) material, which may also be used for playset packaging.

With reference to FIGS. 9, 12, and 13, the PCBA 338 may be disposed in the first covering (or Faraday cage) 340, which may be disposed and/or secured away from the upper portion (or charged portion) of the electrostatic charge generating device 320. For example, the first covering 340, the power supply 313, and the tact switch 342 are shown disposed near a lower portion (or grounded portion) of the electrostatic charge generating device 320 and away from the charged portion of the electrostatic charge generating device 320. This may allow for the first electrode 330 and/or the second covering 344 (which may be a marginally conductive electrode) to collect and/or store more electrostatic charge, as opposed to a situation in which the first covering 340 (and/or other electrical components) are disposed near the charged portion of the electrostatic charge generating device 320. For example, if the PCBA 338 and the connected wires were disposed near the first electrode 330, then these electrical components may reduce an electric field generated in the charged portion of the electrostatic charge generating device 320. Wires may connect the tact switch 342 to the PCBA 338, the PCBA 338 to the power supply 313, the PCBA 338 to the LEDs 346, and the PCBA 338 to the motor 322.

In FIG. 13, the second covering 344 (which may be a marginally conductive electrode) is partially unfolded to show a portion 348 of the second covering 344 that is configured to electrically couple (or electrically connect) the first electrode 330 to the second covering 344. As shown, the portion 348 is an elongate arm that is inserted between the first electrode 330 and the sub-housing 334. With reference to FIGS. 9, 12, and 13, in various embodiments the second covering 344 includes apertures through which arms of the upper yoke 308 may extend, and an aperture through which connector 310 may extend and such an aperture may be dimensioned to allow the proximate end 310*b* of the connector 310 to enter and exit the second covering 344.

When connected to the front housing portion 304*a*, the proximate end 310*b* of the connector 310 may press against (or be disposed proximate) a rear face of the front housing portion 304*a* near the aperture 318 while the distal end 310*a* may project (or protrude through) the aperture 318 to the distal position. In the proximate position, the proximate end 310*b* of connector 310 may be depressed away from the rear face of the front housing portion 304*a* and toward the sub-housing 334. In some embodiments, the distal position may correspond to the connector 310 electrically disconnected from the first electrode 330 and the second covering 344.

In various embodiments, a supporting structure 358 for the tact switch 342 provided and has a rear side 358*a*. The supporting structure 358 may be connected to the front housing portion 304*a* by one or more screws or other fasteners. The tact switch 342 may be disposed on a front side of the supporting structure 358. A spring may be disposed between the supporting structure 358 and the button 312 and may electrically connect the conductive button 312 to ground (e.g., a negative contact of the power supply). To actuate the stand 302, a user may press the button 312 onto the tact switch 342, which may be configured to send a signal to the microcontroller of the PCBA 338 to turn on the electrostatic charge generating device 320. The conductive button 312 may electrically connect the user to the same ground as that of the second electrode 332, such as the negative contact of the power supply 313, and thus allow the electrostatic charge generating device 320 to produce more electrostatic charge. In some embodiments, if the stand 302 includes both the second covering 344 and the button 312 configured to ground the user to the same ground as that of the electrostatic charge generating device 320, then the user may not experience the feeling of an electric shock when the user inadvertently touches the collector 310, touches the (levitated) hair of the doll and then touches another person, and/or touches the collector 310 and then touches another person.

Figure 14:
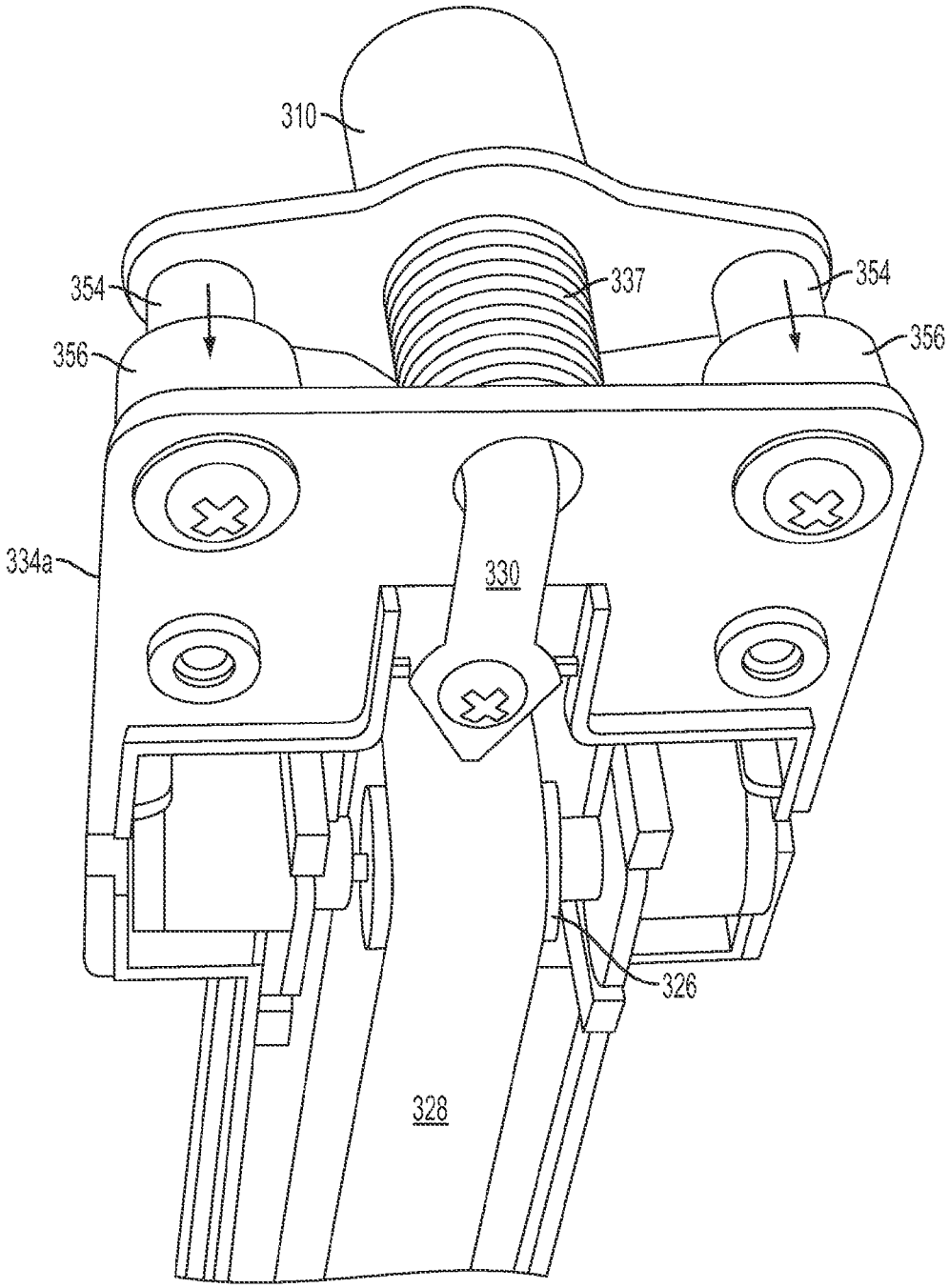
FIG. 14 is a top-back view of a conductive member connected to an electrode of an electrostatic charge generating device and a biasing member for biasing the conductive member in accordance with an embodiment.

FIG. 14 shows various components in accordance with an embodiment. With reference to FIGS. 9 and 14, in various embodiments a spring 337 is disposed between the connector 310 and the front sub-housing portion 334*a* to bias the connector 310 to a distal position. The stand 302 may include any suitable structure, mechanism, and/or apparatus configured to reduce the likelihood of a user inadvertently experiencing the feeling of an electric shock. For example, the spring 337 may be disposed around the sleeve 336 and press against a rear side of the connector 310 to bias the connector 310 away from a proximate position (that may be similar to the proximate position of the playset 200 of FIG. 7B) toward a distal position (that may be similar to the distal position of the playset 200 of FIG. 7A).

The distal position of the connector 310 may correspond to the distal portion 310*a* of the connector 310 disposed distal (or protruding from) the front housing portion 304*a*, and the first electrode 330 disposed away from the belt 328 (similar to the distal position of the first electrode 212 of FIG. 7A), and/or to the connector 310 being electrically disconnected from the first electrode 330. The proximate position of the connector 310 may correspond to the distal portion 310*a* of the connector 310 disposed proximate (or protruding less from) the front face 304*c* of the front housing portion 304*a*, and the first electrode 330 disposed closer to the belt 328 (similar to the proximate position of the first electrode 212 of FIG. 7B), and/or to connector 310 being electrically connected to the first electrode 330.

FIG. 14 shows the connector 310 in the distal position. Moving the connector 310 to the proximate position may involve one or more arms 354 of the connector 310 sliding into one or more guides 356 of the sub-housing 334. As shown, two guides 356 are formed in the sub-housing 334 and the connector 310 includes two arms 354. In other embodiments, the one or more guides may be formed in the connector 310, and the one or more arms may be included in the sub-housing 334 or other suitable structure. In some embodiments, when in the proximate position, the connector 310 may contact (or be electrically connected to) the first electrode 330. Also, in some embodiments, when in the distal position, the connector 310 may be separated (or electrically disconnected) from the first electrode 330.

Figure 15:
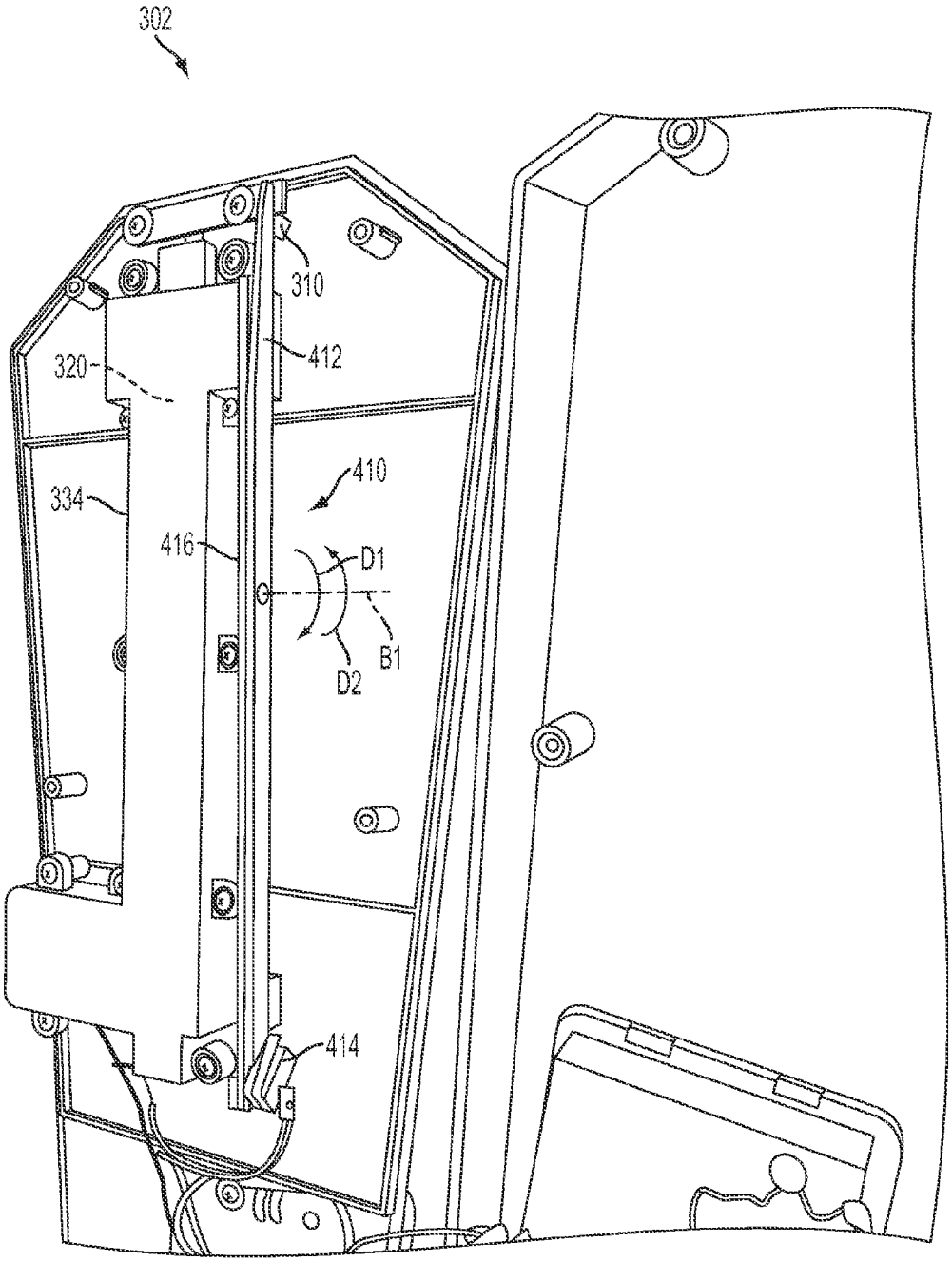
FIG. 15 is a back-side view of a stand with a housing of the stand open to show internal components including an electrical disconnect mechanism in accordance with an embodiment.
Figure 16:
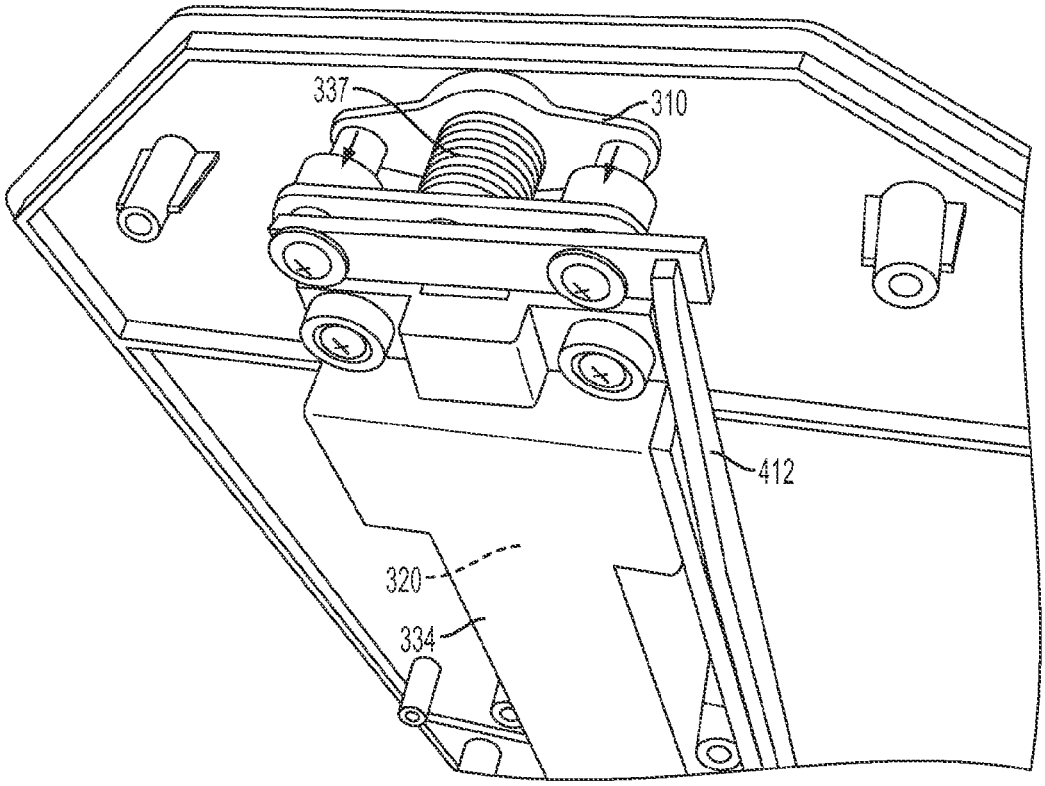
FIG. 16 is a close-up view of an upper portion of FIG. 15.

FIG. 15 illustrates the stand 302 in accordance with an embodiment where the stand 302 includes an embodiment of an electrical disconnect mechanism 410, and FIG. 16 shows some components of the embodiment of the stand 302 of FIG. 15. With reference to FIGS. 15 and 16, the stand 302 includes the electrostatic charge generating device 320, such as a Van de Graaff generator, disposed in the sub-housing 334. The stand 302 may include one or more components of any stand disclosed herein.

The stand 302 as illustrated in FIGS. 15 and 16 includes the conductive member or connector 310 operable between a proximate position and a distal position. With reference to FIGS. 9, 14, 15, and 16, the proximate position of the connector 310 may correspond to a doll positioned in the stand 302 in a supported position with the doll contacting the connector 310, the connector 310 depressed (by the doll) toward the electrostatic charge generating device 320, the connector 310 electrically connected to the first electrode 330 of the electrostatic charge generating device 402, and/or the first electrode 330 disposed proximate the upper pulley 326 and/or the belt 328 of the electrostatic charge generating device 320. The distal position may correspond to the doll removed from the stand 302 to an unsupported position. The connector 310 may be biased to the distal position by the spring 337. Moving the connector 310 from the distal position to the proximate position (as indicated by arrows in FIG. 16) may compress the spring 337. When the doll is removed from the stand 302, the spring 337 pushes the connector 310 back to the distal position.

In various embodiments, the stand 302 may include any suitable mechanism, structure, and/or apparatus configured to allow the electrostatic charge generating device 320 to be powered only when the connector 310 is in the proximate position, which may reduce the likelihood that a user may experience the feeling of an electrostatic shock. For example, the stand 302 may include the electrical disconnect mechanism 410 in accordance with various embodiments. The electrical disconnect mechanism 410 may include a lever 412 and a switch 414. The lever 412 may be pivotally connected to a member of the stand 302 (e.g., a member 416) about a pivot axis B1. The switch 414 may be an electrical switch, and may be operable between an OFF position and an ON position. The OFF position may be configured to prevent the motor 322 of the electrostatic charge generating device 320 from receiving power from the power supply 313, and the ON position may be configured to allow the motor 322 of the electrostatic charge generating device 320 to receive power from the power supply 313.

The lever 412 may extend between the switch 414 and a region proximate the connector 310. Moving the connector 310 from the distal position to the proximate position may pivot the lever 412 about the axis B1 (e.g., in a direction D1) to move the switch 414 from the OFF position to the ON position (e.g., to allow for the motor 322 of the electrostatic charge generating device 320 to be powered and for operation of the electrostatic charge generating device 320). Movement of the connector 310 from the proximate position to the distal position may be configured to pivot the lever 412 about the axis B1 (e.g., in an opposite direction D2) to move the switch 414 (or allow the switch 414 to move) from the ON position to the OFF position (e.g., to prevent the motor 322 of the electrostatic charge generating device 320 from receiving power from the power supply 313, and to prevent operation of the electrostatic charge generating device 320).

Figure 17:
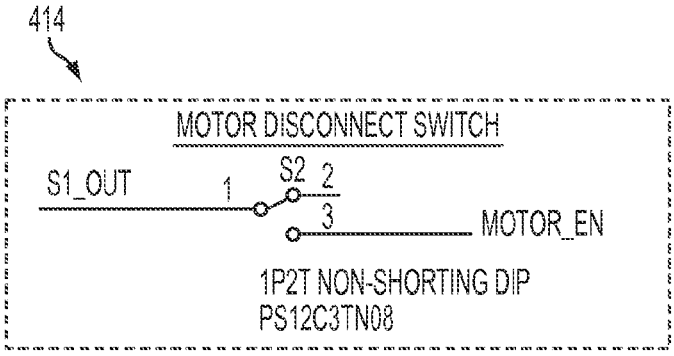
FIG. 17 is a diagram of a switch in accordance with an embodiment.

The switch 414 and any other electrical (or electronic) components may be disposed away from a charged portion of the electrostatic charge generating device 320 to help prevent degradation of an electric field produced by the electrostatic charge generating device 320. For example, FIG. 15 shows the switch 414 disposed distal the charged portion of the electrostatic charge generating device 320 (e.g., the upper portion of the electrostatic charge generating device 320), and proximal the grounded portion of the electrostatic charge generating device 320 (e.g., the lower portion of the electrostatic charge generating device 320). The lever 412 may have a length that allows for the connector 310 to operate the switch 414 disposed away from the connector 310. For example, the length of the lever 412 may be greater than the length (or greater than at least about half of the length) of the electrostatic charge generating device 320, as shown. FIG. 17 is an electrical diagram of the switch 414 in accordance with an embodiment. The switch 414 is operable between an ON position in which it passes current, and an OFF position in which it prevents current from passing.

Figure 18A:
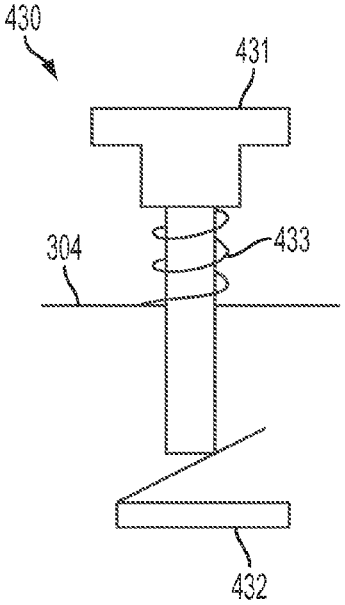
FIG. 18A is a schematic of an electrical disconnect mechanism in accordance with an embodiment.
Figure 18B:
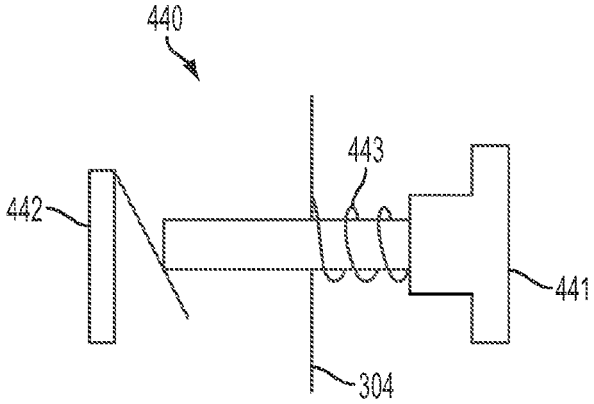
FIG. 18B is a schematic of an electrical disconnect mechanism in accordance with an embodiment.

FIG. 18A is a schematic of an electrical disconnect mechanism 430 in accordance with an embodiment. The electrical disconnect mechanism 430 includes a plunger 431, a switch 432, and a spring 433. The spring 433 is supported on the housing 304 and biases the plunger 431 away from the switch 432. When the plunger 431 is not being pressed, the switch 432 is in an OFF position, and when the plunger 431 is pressed, the switch is placed in the ON position. FIG. 18B is a schematic of an electrical disconnect mechanism 440 in accordance with an embodiment. The electrical disconnect mechanism 440 includes a plunger 441, a switch 442, and a spring 443. The spring 443 is supported on the housing 304 and biases the plunger 441 away from the switch 442. When the plunger 441 is not being pressed, the switch 442 is in an OFF position, and when the plunger 441 is pressed, the switch is placed in the ON position.

Figure 18C:
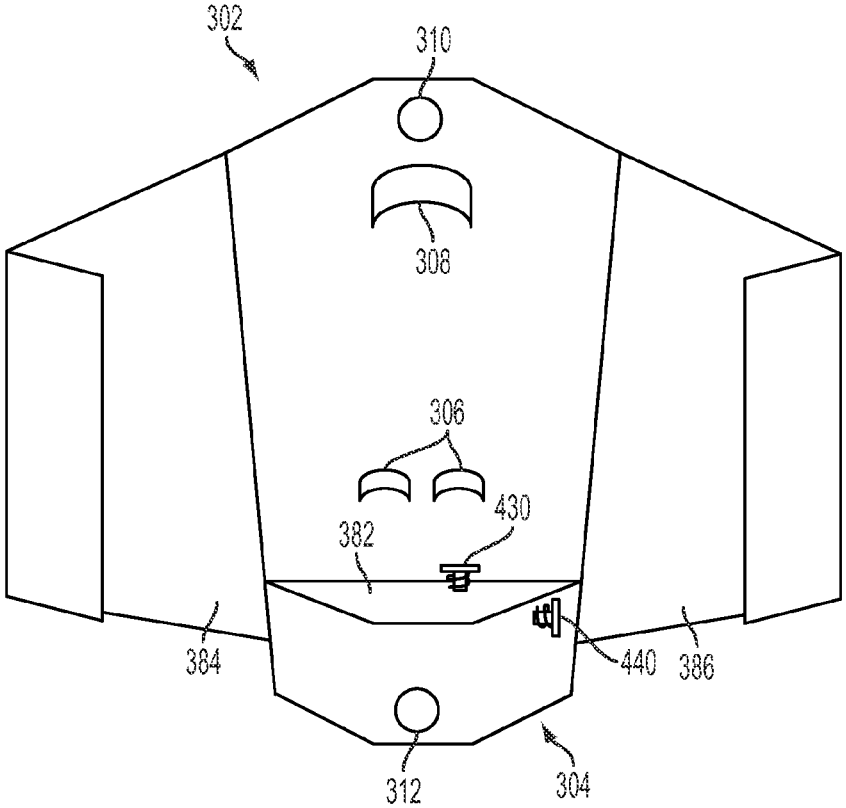
FIG. 18C is a stand with multiple electrical disconnect mechanisms in accordance with an embodiment.

FIG. 18C shows the stand 302 in accordance with an embodiment in which the stand 302 includes the electrical disconnect mechanism 430 and the electrical disconnect mechanism 440. As shown in FIG. 18C, the stand 302 in various embodiments includes the connector 310, the lower yoke 306, the upper yoke 308, the housing 304, and the button 312. In some embodiments, the housing 304 includes a platform 382 on which a doll may be placed. Also, in some embodiments the stand 302 further includes a first door panel 384 and a second door panel 386. With reference to FIGS. 18A, 18B, and 18C, the electrical disconnect mechanism 430 is positioned through the platform 382 of the housing 304 in a location such that when a doll is placed on the platform, a leg of the doll presses down the plunger 431 to move the switch 432 from the OFF position to the ON position. The electrical disconnect mechanism 440 is positioned through the housing 304 in a location such that when the second door panel 386 is closed, the second door panel 386 presses down the plunger 441 to move the switch 442 from the OFF position to the ON position. In various embodiments, the switch 432 and the switch 442 have an operation that is the same as the switch 414 of FIG. 17.

With reference to FIGS. 10, 11, 14, 18A, 18B, and 18C, in various embodiments the electrical disconnect mechanism 430 is electrically connected within the stand 302 and configured such that it is operable among a first position (e.g., the OFF position) in which the electrostatic charge generating device 320 is prevented from receiving power from the power supply 313 and a second position (e.g., the ON position) in which the electrostatic charge generating device 320 is allowed to receive power from the power supply 313. Also, in various embodiments the electrical disconnect mechanism 440 is electrically connected within the stand 302 and configured such that it is operable among a first position (e.g., the OFF position) in which the electrostatic charge generating device 320 is prevented from receiving power from the power supply 313 and a second position (e.g., the ON position) in which the electrostatic charge generating device 320 is allowed to receive power from the power supply 313. In some embodiments, both the electrical disconnect mechanism 430 and the electrical disconnect mechanism 440 must be in ON positions for the electrostatic charge generating device 320 to be allowed to receive power from the power supply 313. In some embodiments, the electrical disconnect mechanism 430 employs a sensor rather than the plunger 431 and spring 433 to control the switch 432. Also, in some embodiments, the electrical disconnect mechanism 440 employs a sensor rather than the plunger 441 and spring 443 to control the switch 442.

With reference to FIGS. 1, 8-10, 12-16, and 18A-18C, in various embodiments the stand 302 includes a supporting structure 390 for supporting a doll, such as the doll 24. In various embodiments, the supporting structure 390 includes the housing 304. In some embodiments, the supporting structure 390 further includes the lower yoke 306, the upper yoke 308, and the connector 310. The stand 302 also includes the electrostatic charge generating device 320 supported by the housing 304, for causing hair of the doll 24 to move when the doll 24 is supported by the housing 304, and the electrostatic charge generating device 320 is activated.

In various embodiments the connector 310 is a conductive member and allows for contacting the doll 24 and for transferring charge generated by the electrostatic charge generating device 320 to the doll 24. In some embodiments, the connector 310 comprises carbon-impregnated plastic. In various embodiments the connector 310 is a conductive member and is movable among a first position (e.g., a distal position) in which charge is hindered from being transferred from the electrostatic charge generating device 320 through the connector 310 and a second position (e.g., a proximate position) that promotes the transfer of charge from the electrostatic charge generating device 320 through the connector 310. In various embodiments, the spring 337 is a biasing member for biasing the connector 310 toward the first position. In various embodiments, the connector 310 is positioned in a location such that the connector 310 is placed into the second position by the doll 24 when the doll 24 is supported by the supporting structure 390. In some embodiments, the connector 310 is formed as a yoke for holding a portion of the doll 24, such as having a yoke shape like the yoke third yoke 52 of the stand 22.

In various embodiments, the electrostatic charge generating device 320 includes the belt 328 that is on the upper pulley 326 and the lower pulley 324 for generating charge, and also includes the first electrode 330 for collecting charge from the belt 328. In some embodiments, the connector 310 is connected to the first electrode 330 and that is moveable from the first position to the second position, where the first electrode 330 is closer to the belt 328 when the connector 310 is in the second position than when the connector 310 is in the first position. In some embodiments, the first electrode 330 is located far enough away from the belt 328 when the connector 310 is in the first position such that charge is hindered from collecting on the first electrode 330 from the belt 328 when the connector 310 is in the first position. Also, in some embodiments, the connector 310 is biased toward the first position by the spring 337. In various embodiments, the connector 310 is positioned in a location such that the connector 310 is placed into the second position by the doll 24 when the doll 24 is supported by the supporting structure 390.

In various embodiments, the stand 302 includes the electrical disconnect mechanism 410, where the electrical disconnect mechanism 410 is connected to the connector 310 of the stand 302. In some embodiments where the stand 302 includes the electrical disconnect mechanism 410, the electrical disconnect mechanism 410 is operable among a first position in which the electrostatic charge generating device 320 is prevented from receiving power from the power supply 313 and a second position in which the electrostatic charge generating device 320 is allowed to receive power from the power supply 313. Also, in some embodiments, the electrical disconnect mechanism 410 is configured such that the electrical disconnect mechanism 410 is in the first position when there is no doll being supported by the supporting structure 390. In some embodiments, the electrical disconnect mechanism 410 is configured such that the electrical disconnect mechanism 410 is placed into the second position when the doll 24 is supported by the supporting structure 390.

In some embodiments, the electrical disconnect mechanism 410 includes the switch 414. In some embodiments, the connector 310 is connected to the electrical disconnect mechanism 410, and the electrical disconnect mechanism 410 further includes the lever 412 extending between the connector 310 and the switch 414, and the lever 412 is moveable to control the switch 414 in response to a movement of the connector 310. In various embodiments, the connector 310 contacts the doll 24 when the doll 24 is supported by the supporting structure 390, and the movement of the connector 310 causes the lever 412 to activate the switch 414.

In various embodiments the support structure 390 includes the platform 382 of the housing 304, and the stand 302 includes the electrical disconnect mechanism 430 configured such that the electrical disconnect mechanism 430 is moved from the OFF position to the ON position when the doll 24 is standing on the platform 382. In some embodiments, the supporting structure 390 further includes the second door panel 386 that is moveable among an open position and a closed position, and the stand 302 further includes the electrical disconnect mechanism 440 that is configured such that the electrical disconnect mechanism 440 is placed into the OFF position when the second door panel 386 is in the open position and is placed into the ON position when the second door panel 386 is in the closed position.

In various embodiments, the stand 302 includes the PCBA 338 for controlling the electrostatic charge generating device 320, and also includes the first covering 340, which may be a Faraday cage, surrounding the PCBA 338. In some embodiments, the housing 304 of the supporting structure 390 comprises at least one material selected from the group consisting of acrylonitrile butadiene styrene and styrene. In some embodiments, the electrostatic charge generating device 320 includes the first electrode 330, and the stand 302 includes the second covering 344, which may be a marginally conductive electrode, for collecting charge from the first electrode 330 of the electrostatic charge generating device 320. In some embodiments, the second covering 344 comprises at least one material selected from the group consisting of paper, cardboard, metal foil, metallized plastic, and foil covered paper. In various embodiments, the electrostatic charge generating device 320 is a Van de Graaff generator and the Van de Graaff generator is located inside of the housing 304 of the supporting structure 390.

In some embodiments, the supporting structure 390 includes the connector 310, which may be a conductive member, for contacting the doll 24 and for transferring charge generated by the electrostatic charge generating device 320 to the doll 24, where the connector 310 is movable among a first position in which charge is hindered from being transferred from the electrostatic charge generating device 320 through the connector 310 and a second position that promotes the transfer of charge from the electrostatic charge generating device 320 through the connector 310. In some such embodiments, the stand further includes the electrical disconnect mechanism 410 that is operable among a first position in which the electrostatic charge generating device 320 is prevented from receiving power from the power supply 313 and a second position in which the electrostatic charge generating device 320 is allowed to receive power from the power supply 313.

Figure 19:
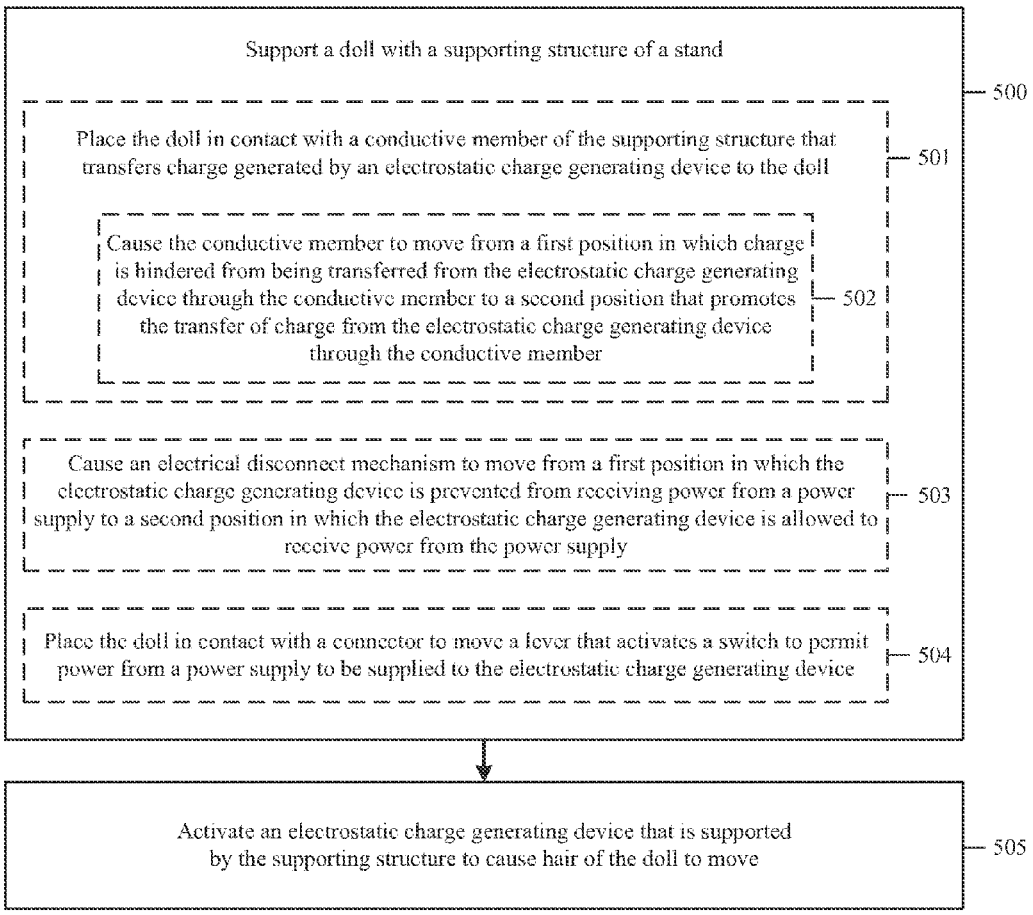
FIG. 19 is a flowchart of a method in accordance with an embodiment.

FIG. 19 is a flowchart of a method of using a stand for a doll in accordance with various embodiments. With reference to FIGS. 1, 6, 8, 9, 12, 15, and 19, in step 500 the doll 24 is supported with the supporting structure 390 of the stand 302. In various embodiments, the step 500 includes step 501 of placing the doll 24 in contact with the connector 310, which may be a conductive member of the supporting structure 390, that transfers charge generated by the electrostatic charge generating device 320 to the doll 24. In some embodiments, the connector 310 is a conductive member and is made of carbon-impregnated plastic. In some embodiments, the step 501 includes step 502 where placing the doll 24 in contact with the connector 310, which may be a conductive member, causes the connector 310 to move from a first position in which charge is hindered from being transferred from the electrostatic charge generating device 320 through the connector 310 to a second position that promotes the transfer of charge from the electrostatic charge generating device 320 through the connector 310.

In some embodiments, the step 500 includes step 503 of causing the electrical disconnect mechanism 410 to move from a first position in which the electrostatic charge generating device 320 is prevented from receiving power from the power supply 313 to a second position in which the electrostatic charge generating device 320 is allowed to receive power from the power supply 313. Also, in some embodiments, the step 500 includes step 504 of placing the doll 24 in contact with the connector 310 to move the lever 412 that activates the switch 414 to permit power from the power supply 313 to be supplied to the electrostatic charge generating device 320. The method then continues to step 505. In step 505, the electrostatic charge generating device 320 that is supported by the supporting structure 390 is activated to cause the hair 26 of the doll 24 to move.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. Various modifications and changes that come within the meaning and range of equivalency of the claims are intended to be within the scope of the invention.

What is claimed is:

1. A stand, comprising:

a supporting structure for supporting a doll that is distinct from the supporting structure;

an electrostatic charge generating device located within the supporting structure for causing hair of the doll to move when the doll is supported by the supporting structure and the electrostatic charge generating device is activated; and an electrical disconnect mechanism for automatically preventing a power supply from powering the electrostatic charge generating device when there is no doll supported by the supporting structure.

2. The stand of claim 1, further comprising:

a printed circuit board assembly for controlling the electrostatic charge generating device; and a covering formed as a Faraday cage for the printed circuit board assembly.

3. The stand of claim 2, wherein the covering comprises paper and a conductive material attached to the paper.

4. The stand of claim 2, further comprising:

one or more light sources supported by the supporting structure;

wherein the printed circuit board assembly is configured to control the electrostatic charge generating device and the one or more light sources in response to actuation of an activation mechanism.

5. The stand of claim 2, wherein the electrostatic charge generating device includes a first electrode that is charged when the electrostatic charge generating device is activated, and a second electrode that is grounded; and wherein the printed circuit board assembly is located closer to the second electrode than to the first electrode.

6. The stand of claim 2, wherein the printed circuit board assembly is supported by the supporting structure.

7. The stand of claim 1, wherein the electrical disconnect mechanism is operable among a first position in which the electrostatic charge generating device is prevented from receiving power from the power supply and a second position in which the electrostatic charge generating device is allowed to receive power from the power supply.

8. The stand of claim 1, further comprising:

a conductive member for transferring charge generated by the electrostatic charge generating device;

wherein the conductive member is connected to the electrical disconnect mechanism.

9. The stand of claim 1, further comprising:

a conductive member for contacting the doll and for transferring charge generated by the electrostatic charge generating device to the doll.

10. The stand of claim 9, wherein the conductive member comprises carbon-impregnated plastic.

11. A stand, comprising:

a supporting structure for supporting a doll;

an electrostatic charge generating device supported by the supporting structure for causing hair of the doll to move when the doll is supported by the supporting structure and the electrostatic charge generating device is activated;

one or more light sources supported by the supporting structure; and an electrical disconnect mechanism for preventing a power supply from powering the electrostatic charge generating device when there is no doll supported by the supporting structure;

wherein the electrical disconnect mechanism comprises a switch connected to a motor of the electrostatic charge generating device.

12. The stand of claim 11, wherein the electrical disconnect mechanism further comprises a lever for activating the switch when the doll is supported by the supporting structure.

13. The stand of claim 11, wherein the electrostatic charge generating device includes a first electrode that is charged when the electrostatic charge generating device is activated, and a second electrode that is grounded; and wherein the switch is located closer to the second electrode than to the first electrode.

14. A stand, comprising:

a supporting structure for supporting a doll;

an electrostatic charge generating device supported by the supporting structure for causing hair of the doll to move when the doll is supported by the supporting structure and the electrostatic charge generating device is activated; and one or more light sources supported by the supporting structure;

wherein the supporting structure comprises a platform for supporting the doll; and wherein the stand further comprises an electrical disconnect mechanism that is configured to prevent a power supply from powering the electrostatic charge generating device when there is no doll on the platform.

15. A stand, comprising:

a supporting structure for supporting a doll;

an electrostatic charge generating device supported by the supporting structure for causing hair of the doll to move when the doll is supported by the supporting structure and the electrostatic charge generating device is activated; and one or more light sources supported by the supporting structure;

wherein the supporting structure comprises a door panel that is moveable among an open position and a closed position; and wherein the stand further comprises an electrical disconnect mechanism that is configured to prevent a power supply from powering the electrostatic charge generating device when the door panel is in the open position.

16. A stand, comprising:

a supporting structure for supporting a doll;

an electrostatic charge generating device supported by the supporting structure for causing hair of the doll to move when the doll is supported by the supporting structure and the electrostatic charge generating device is activated;

one or more light sources supported by the supporting structure; and a conductive member for contacting the doll and for transferring charge generated by the electrostatic charge generating device to the doll;

wherein the electrostatic charge generating device comprises a belt that is on pulleys for generating charge and an electrode for collecting charge from the belt; and wherein the conductive member comprises a connector in contact with the electrode that is moveable from a first position to a second position, and wherein the electrode is closer to the belt when the connector is in the second position than when the connector is in the first position.

17. The stand of claim 16, wherein the connector is positioned in a location such that the connector is placed into the second position by the doll when the doll is supported by the supporting structure.

18. A stand, comprising:

a supporting structure for supporting a doll;

an electrostatic charge generating device supported by the supporting structure for causing hair of the doll to move when the doll is supported by the supporting structure and the electrostatic charge generating device is activated;

one or more light sources supported by the supporting structure; and a conductive member for contacting the doll and for transferring charge generated by the electrostatic charge generating device to the doll;

wherein the conductive member is movable among a first position in which charge is hindered from being transferred from the electrostatic charge generating device through the conductive member and a second position that promotes the transfer of charge from the electrostatic charge generating device through the conductive member.

19. A stand, comprising:

a supporting structure for supporting a doll that is distinct from the supporting structure;

an electrostatic charge generating device located within the supporting structure for causing hair of the doll to move when the doll is supported by the supporting structure and the electrostatic charge generating device is activated;

a speaker supported by the supporting structure for emitting one or more sound; and an electrical disconnect mechanism for automatically preventing a power supply from powering the electrostatic charge generating device when there is no doll supported by the supporting structure.

* * * * *